US008326540B2

(12) United States Patent
Hull et al.

(10) Patent No.: US 8,326,540 B2
(45) Date of Patent: Dec. 4, 2012

(54) METHOD AND APPARATUS FOR FLUID MIGRATION PROFILING

(75) Inventors: John Hull, Calgary (CA); Hermann Kramer, Calgary (CA)

(73) Assignee: HiFi Engineering, Inc., Calgary, Alberta (CA)

( * ) Notice: Subject to any disclaimer, the term of this patent is extended or adjusted under 35 U.S.C. 154(b) by 328 days.

(21) Appl. No.: 12/438,479

(22) PCT Filed: Feb. 12, 2008

(86) PCT No.: PCT/CA2008/000314
§ 371 (c)(1),
(2), (4) Date: Jun. 23, 2009

(87) PCT Pub. No.: WO2008/098380
PCT Pub. Date: Aug. 21, 2008

(65) Prior Publication Data

US 2009/0326826 A1 Dec. 31, 2009

Related U.S. Application Data

(60) Provisional application No. 60/901,299, filed on Feb. 15, 2007.

(51) Int. Cl.
*G01V 1/40* (2006.01)
*G01V 3/00* (2006.01)
*G01V 5/00* (2006.01)

(52) U.S. Cl. ..... 702/8; 324/332; 250/258

(58) Field of Classification Search ..... 702/8, 1–2, 702/6, 9, 11–14, 16–18, 33, 40, 42–43, 45, 702/49–50, 54–55, 75–77, 81, 84, 127, 130, 702/134, 136–138, 140, 149–150, 155–159, 702/166, 171–172, 182–183, 188–191; 73/1.16, 73/1.22, 1.41, 1.45–1.46, 1.48, 1.56–1.57, 73/1.73, 1.79, 1.81–1.83, 1.85, 152.01, 152.12, 73/152.15–152.16, 152.18, 152.21–152.22, 73/152.29, 152.31–152.33, 152.43–152.44, 73/152.46–152.47, 152.51–152.52, 202.5, 73/861, 861.18, 861.23, 861.25–861.28; 166/244.1, 249, 250.01, 250.08, 250.16; 324/323–324, 332–335, 337–338, 344, 346–347; 250/253–254, 256, 258, 261–267, 269.1–269.2; 367/14–15, 21, 25, 31–33, 35, 69, 73, 76, 367/78, 80–82, 86; 181/101–102, 105, 108, 181/113, 122; 356/447, 450, 477–478, 484; 340/853.1–853.2, 854.1, 854.5, 854.7, 854.9, 340/855.1, 855.3–855.7, 856.3–856.4, 853.1–853.2
See application file for complete search history.

(56) References Cited

U.S. PATENT DOCUMENTS 2,210,417 A 8/1940 Kinley ..... 73/40.5 A (Continued)

FOREIGN PATENT DOCUMENTS

CA 2342611 3/2000

(Continued)

OTHER PUBLICATIONS

Hill, K.O., "Photosensitivity in optical fiber waveguides: application to reflection fiber fabrication," Appl. Phys. Lett. 32: 647, 1978.

(Continued)

*Primary Examiner* — Toan M Le
(74) *Attorney, Agent, or Firm* — Klarquist Sparkman, LLP

(57) ABSTRACT

The method for obtaining a fluid migration profile for a wellbore, including the steps of obtaining a static profile for a logged region of the wellbore, obtaining a dynamic profile for the logged region of the wellbore, digitally filtering the dynamic profile to remove frequency elements represented in the static profile, to provide a fluid migration profile, and storing the fluid migration profile on a computer-readable memory.

21 Claims, 16 Drawing Sheets

U.S. PATENT DOCUMENTS

| | | | | |
|---|---|---|---|---|
| 4,046,220 | A | 9/1977 | Glenn, Jr. | 181/105 |
| 5,327,969 | A | 7/1994 | Sabins et al. | 166/250.14 |
| 5,503,227 | A | 4/1996 | Saponja et al. | 166/277 |
| 6,269,198 | B1 | 7/2001 | Hodgson et al. | 385/13 |
| 6,724,319 | B1 | 4/2004 | Knaack et al. | 340/857.7 |
| 6,728,165 | B1 | 4/2004 | Roscigno et al. | 367/14 |
| 6,913,079 | B2 * | 7/2005 | Tubel | 166/250.01 |
| 2003/0202762 | A1 | 10/2003 | Ukrainczyk et al. | 385/124 |
| 2006/0133203 | A1 | 6/2006 | James et al. | 367/27 |
| 2006/0153508 | A1 | 7/2006 | Bowker et al. | 385/100 |

FOREIGN PATENT DOCUMENTS

| | | |
|---|---|---|
| CA | 2 320 394 | 4/2001 |
| WO | WO-2005/054801 | 6/2005 |

OTHER PUBLICATIONS

Meltz, G. et al, "Formation of Bragg gratings in optical fibers by a transverse holographic method," Opt. Lett. 14: 823, 1989.

Erdogan, T. "Fiber Grating Spectra," Journal of Lightwave Technology 15 (8):1277-1294, 1997.

Dakin, J. P. et al:"Distributed Optical Fibre Raman Temperature Sensor using a semiconductor light source and detector," Electronics Letters 21, 1985, pp. 569-570.

Danielson: "Optical time-domain reflectometer specifications and performance testing," Applied Optics vol. 24 (15): pp. 2313-2322 (1985).

OPD-4000 Optical Phase Demodulator, Optiphase, Inc. product literature,, Optiphase, Inc., Van Nuys, CA, 2003-2006.

PZ1 Low-profile Fiber Stretcher, Optiphase product literature, Optiphase, Inc. Van Nuys, CA, 2003-2006.

PZ2 High-efficiency Fiber Stretcher, Optiphase product Literature, Optiphase, Inc. Van Nuys, CA, 2003-2009.

LxDATA (Formerly LxSix Photonics) product literature, St. Laurent, Quebec, Apr. 2008.

International Preliminary Report on Patentability,IB/Geneva, issued Aug. 19, 2009, incorporating the Written Opinion of the ISA, ISA/CA, Gatineau, Quebec, mailed May 30, 2008.

* cited by examiner note If PZ2 with RC fiber is used would work at 20 KHz with 30V p-p

METHOD AND APPARATUS FOR FLUID MIGRATION PROFILING

CROSS-REFERENCE TO RELATED APPLICATIONS

This application is a 371 U.S. National Stage of International Application No. PCT/CA2008/000314, filed Feb. 12, 2008 and published in English as WO 2008/098380 A1 on Aug. 21, 2008. This application claims the benefit of U.S. Provisional Application No. 60/901,299, filed Feb. 15, 2007. The disclosures of the above applications are entirely incorporated herein by reference.

FIELD OF INVENTION

The present invention relates to methods for profiling fluid migration in oil or gas wells.

BACKGROUND OF THE INVENTION

Casing vent flow/gas migration (CVF/GM) analysis is becoming a major concern for oil/gas producers around the world. In order for the gas to negotiate itself from the source to surface, a path must be present. This path can be due to fractures around the wellbore, fractures in the production tubing, poor casing to cement/cement to formation bond, channeling in the cement, or various other reasons.

Well logging is performed at various stages in the life of a well—during the drilling process (pre-production), while a well is in operation (production) and periodically when the well is no longer in service (abandoned). Information obtained by well logging may include temperature, pressure or acoustic information on the wellbore, production tubing, surrounding casing or reservoir matrix, geological makeup of the strata through which the wellbore is drilled, or the reservoir matrix, and the like.

Methods currently used in the oil and gas industry for well logging include, for example, Pulsed Neutron Neutron logging (PNN) (used for assessing the elements in a formation), Cement Bond Logging (CBL) (used for assessing casing cement integrity), noise/temperature logging, Radial Bond Logging (RBL), Compensated Neutron Logging (CNL) (used for assessing porosity of a formation). Seismic detection methods using geophones and artificial acoustic signal sources, provide information relating to the geologic strata in the area of the well. For example, acoustic sensing systems employing optical sensors and fiber for downhole seismic applications are known. CA2320394 describes a system for detecting an acoustic signal produced by an artificial source in a second wellbore to identify differential propagation of acoustic waves in the earth formation. CA 2342611 discloses a system including an acoustic transmitter (an artificial source) for seismic sensing, for use in acquiring information about the properties of the earth formations in the borehole where it is deployed. Artificial sources for the acoustic signal may be used, such as an air gun, a vibrator, an explosive charge or the like to produce a seismic wave. These may be quite violent, producing an acoustic signal that is felt on the surface, or at a significant distance from the source.

CVF/GM may occur at any time in the life of the well. Wells found to have aberrant or undesired fluid (generally, gas or liquid hydrocarbon) migration (a 'leak') must be repaired to stop the leak. This may entail halting a producing well, or making the repairs on an abandoned or suspended well. The repair of these situations does not generate revenue for the gas company, and can cost millions of dollars per well to fix the problem.

In order to deal with the leak, a basic strategy may include these steps: identify the gas source that is responsible for the problem; communicate with the leaking fluid source (i.e. making holes in production tubing and/or cement in order to effectively access the formation), and; plug, cover or otherwise stop the leak (i.e. inject or apply cement above and into the culprit formation in order to seal or 'plug' the gas source, preventing future leaks).

Materials and Methods for stopping leaks associated with oil or gas wells are known, and usually involve injection of a liquid or semiliquid matrix that sets into a gas-impermeable layer. For example, U.S. Pat. No. 5,500,3227 to Saponja et al. describes methods of terminating undesirable gas or liquid hydrocarbon migration in wells. U.S. Pat. No. 5,327,969 to Sabins et al describes methods of preventing gas or liquid hydrocarbon migration during the primary well cementing stage.

Before the leak can be stopped however, it must be identified and localized. Existing systems for identification of a leak comprise a detection device, such as a single microphone at the end of a cable or wire. The microphone is lowered into the well, and suspended at a depth of interest, and background acoustic activity at that depth is recorded for a short period of time. The device is then raised up a short distance (repositioned) and the process repeated. The recording interval may range from about 10 seconds to about 1 minute, and the repositioning distance from about 2 meters to about 5 meters. Longer recording intervals and shorter repositioning distances may give more accurate data, but at the expense of time. Once data collection is complete, the acoustic data is processed and the noise signature of the well characterized. This serial, stepwise monitoring of well depths is slow—a typical well may take 6-12 hours to log. For deep wells, the time involved in this serial data acquisition can be substantial. For example, total logging time, comprising stabilization time, repositioning and actual recording time for each depth may take up to 12 hours for a 1000 m well. Additionally, as the recording device is only recording data at each depth for one minute or thereabouts, the recording device may not be directly at the leak point when a noise anomaly occurs—for a well with a low leak rate, a noise anomaly may be missed altogether. The length of the wire, and in the case of an analog signal, filtering and bandwidth limitations, also take a toll on the data by the time it is actually received uphole into the computer acquisition system, resulting in a poor signal to noise ratio.

Acquisition of reliable data in a timely manner for identification of the gas source is a key step in the process of stopping leaks from a wellbore, and improved methodologies and apparatus are desirable.

SUMMARY OF THE INVENTION

In accordance with one aspect of the invention, there is provided a method for obtaining a fluid migration profile for a wellbore, comprising the steps of:

a) obtaining a static profile for a logged region of the wellbore, the static profile including events unrelated to fluid migration in the wellbore;

b) obtaining a dynamic profile for the logged region of the wellbore, the dynamic profile including events related and unrelated to fluid migration in the wellbore: and c) digitally processing the static and dynamic profiles to filter out the events unrelated to fluid migration from the static profile, thereby obtaining the fluid migration profile.

In accordance with another aspect of the invention, the static profile may be obtained by a measurement method which acquires event data comprising at least one of coherent Rayleigh data, digital temperature sensing data or digital noise array data.

In accordance with another aspect of the invention, the dynamic profile may be obtained by a measurement method which acquires event data comprising at least one of coherent Rayleigh data, digital temperature sensing data or digital noise array data.

In accordance with another aspect of the invention, the step of obtaining a static profile for a logged region of the wellbore comprises the steps of:

a) placing a fiber optic cable assembly in the wellbore at a first location;

b) pressurizing the wellbore and allowing the pressure to equilibrate;

c) operating a laser light assembly to send laser light along a coherent Rayleigh transmission line, digital temperature sensor transmission line or digital noise array transmission line;

d) collecting coherent Rayleigh data, digital temperature sensor data or digital noise array data;

e) demodulating the collected coherent Rayleigh data, digital temperature sensor data or digital noise array data; and f) i) transforming the demodulated coherent Rayleigh data or digital noise array data; or ii) integrating the digital temperature sensor data over time.

In accordance with another aspect of the invention, the step of obtaining a dynamic profile for a logged region of the wellbore comprises the steps of:

a) positioning a fiber optic cable assembly in the wellbore at a first location;

b) releasing the pressure in a pressurized wellbore;

c) operating a laser light assembly to send laser light along a coherent Rayleigh transmission line, digital temperature sensor transmission line or digital noise array transmission line d) collecting coherent Rayleigh data, digital temperature sensor data or digital noise array data;

e) demodulating the collected coherent Rayleigh data, digital temperature sensor data or digital noise array data; and f) i) transforming the demodulated coherent Rayleigh data or digital noise array data; or ii) integrating the digital temperature sensor data over time.

In accordance with another aspect of the invention, the step for collecting digital noise array data further comprises raising the digital noise array by one array span in step d) and repeating steps d) to f).

In accordance with another aspect of the invention, the step for collecting digital noise array data further comprises raising the digital noise array by one array span in step d) and repeating steps d) to f).

In accordance with another aspect of the invention, there is provided a computer readable memory having recorded thereon statements and instructions for execution by a computer to carry out the a method for obtaining a fluid migration profile for a wellbore, the method comprising the steps of:

a) obtaining a static profile for a logged region of the wellbore, the static profile including events unrelated to fluid migration in the wellbore;

b) obtaining a dynamic profile for the logged region of the wellbore, the dynamic profile including events related and unrelated to fluid migration in the wellbore: and c) digitally processing the static and dynamic profiles to filter out the events unrelated to fluid migration from the static profile, thereby obtaining the fluid migration profile.

In accordance with another aspect of the invention, there is provided an apparatus for obtaining a fluid migration profile for a wellbore, comprising:

a) a fiber optic cable assembly operable to obtain a static profile and a dynamic profile for a logged region of the wellbore, the static profile comprising events unrelated to fluid migration in the wellbore and the dynamic profile comprising events related and unrelated to fluid migration in the wellbore; and b) a data acquisition unit comprising:

a laser light assembly optically coupled to and operable to transmit laser light to the fiber optic cable assembly;

optical signal processing equipment optically coupled to and operable to process optical signals from the fiber optic cable assembly representing the static and dynamic profiles and a computer-readable memory communicative with the optical signal processing equipment and having recorded thereon statements and instructions for processing the static and dynamic profiles to filter out events unrelated to fluid migration from the static profile, thereby obtaining a fluid migration profile.

In accordance with another aspect of the invention, the fiber optic cable assembly may be configured for at least one of collecting coherent Rayleigh data, collecting digital temperature sensing data or collecting digital noise array data.

In accordance with another aspect of the invention, the fiber optic cable assembly configured for collecting coherent Rayleigh data comprises a single mode optical fiber.

In accordance with another aspect of the invention, the fiber optic cable assembly configured for collecting digital temperature sensing data comprises a multi-mode optical fiber.

In accordance with another aspect of the invention, the fiber optic cable assembly configured for collecting digital noise array data comprises a single mode optical fiber comprising a plurality of optical filter separated by an intervening length of single mode optical fiber.

In accordance with another aspect of the invention, the intervening length of single mode optical fiber is wound around a mandrel.

In accordance with another aspect of the invention, there is provide a computer program product, comprising: a memory having computer readable code embodied therein, for execution by a CPU, for receiving demodulated optical data obtained from a static profile and a dynamic profile of a wellbore, the code comprising:

a) a transformation protocol for transforming demodulated data;

b) an integration protocol for integrating the demodulated data over time; and c) a digital filtering protocol for digitally filtering the dynamic profile to remove frequency elements represented in the static profile, to provide a fluid migration profile.

In accordance with another aspect of the invention, the demodulated optical data includes coherent Rayleigh data, demodulated digital temperature sensing data or demodulated digital noise array data.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION OF EMBODIMENTS OF THE INVENTION

Apparatus

Figure 1:
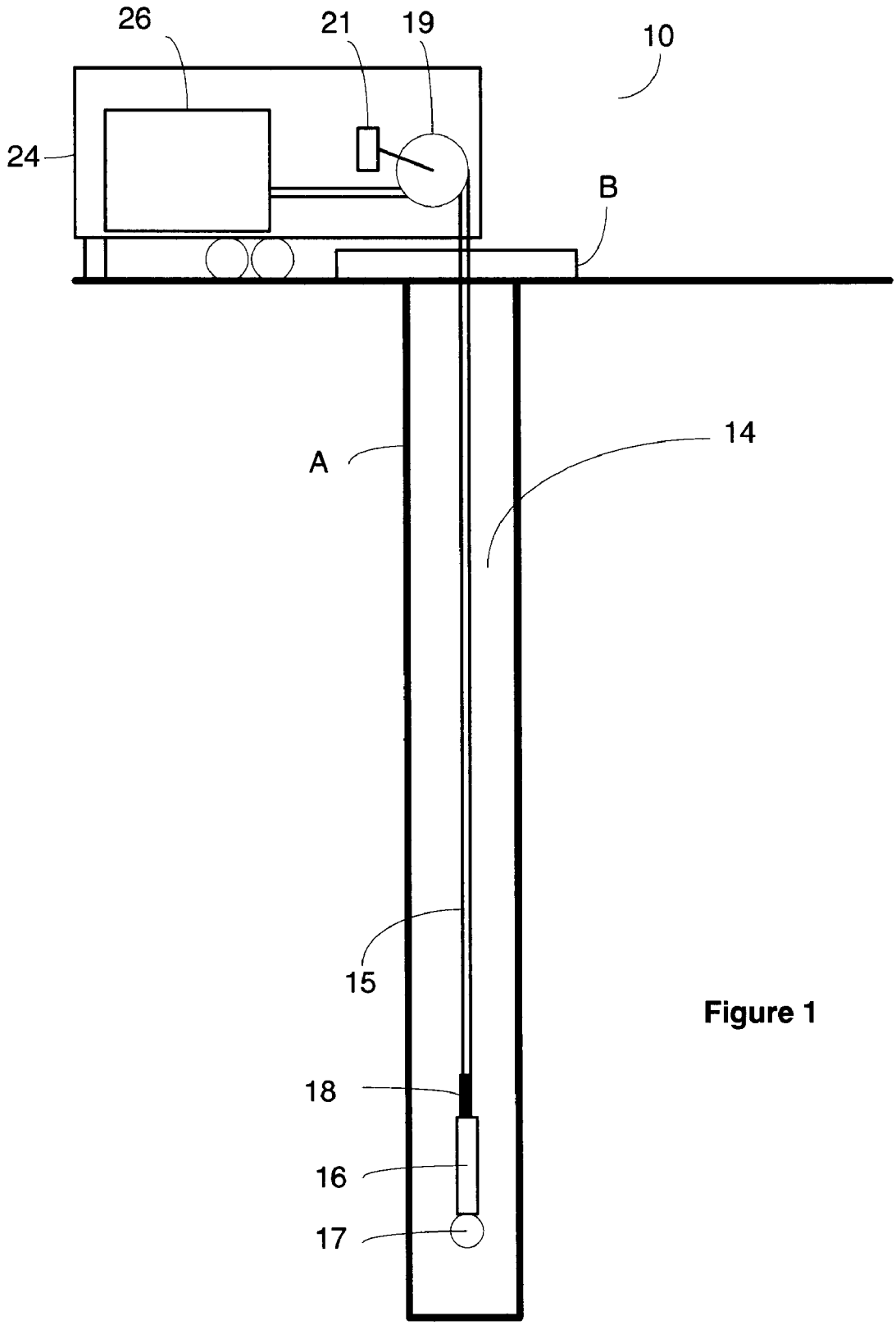
FIG. 1 is a schematic side elevation view of a gas migration detection and analysis apparatus in accordance with an embodiment of the present invention.

Referring to FIG. 1 and according to one embodiment of the invention, there is provided an apparatus 10 for detecting and analyzing fluid migration in an oil or gas well. Fluid migration in oil or gas wells is generally referred to as "casing vent flow/gas migration" and is understood to mean ingress or egress of a fluid along a vertical depth of an oil or gas well, including movement of a fluid behind or external to a production casing of a wellbore. The fluid includes gas or liquid hydrocarbons, including oil, as well as water, steam, or a combination thereof. A variety of compounds may be found in a leaking well, including methane, pentanes, hexanes, octanes, ethane, sulphides, sulphur dioxide, sulphur, petroleum hydrocarbons (six- to thirty four-carbons or greater), oils or greases, as well as other odour-causing compounds. Some compounds may be soluble in water, to varying degrees, and represent potential contaminants in ground or surface water. Any sort of aberrant or undesired fluid migration is considered a leak and the apparatus 10 is used to detect and analyze such leaks in order to facilitate repair of the leak. Such leaks can occur in producing wells or in abandoned wells, or wells where production has been suspended.

The acoustic signals (as well as changes in temperature) resulting from migration of fluid may be used as an identifier, or 'diagnostic' of a leaking well. As an example, the gas may migrate as a bubble from the source up towards the surface, frequently taking a convoluted path that may progress into and/or out of the production casing, surrounding earth strata and cement casing of the wellbore, and may exit into the atmosphere through a vent in the well, or through the ground. As the bubble migrates, pressure may change and the bubble may expand or contract, and/or increase or decrease the rate of migration. Bubble movement may produce an acoustic signal of varying frequency and amplitude, with a portion in the range of 20-20,000 Hz. This migration may also result in temperature changes (due to expansion or compression) that are detectable by the apparatus and methods of various embodiments of the invention.

The apparatus 10 shown in FIG. 1 includes a flexible fiber optic cable assembly 14 comprising a fiber optic cable 15 and an acoustic transducer array 16 connected to a distal end of the cable 15 by an optical connector 18, and a weight 17 coupled to the distal end of the transducer array 16. The apparatus 10 also includes a surface data acquisition unit 24 that stores and deploys the cable assembly 14 as well as receives and processes raw measurement data from the cable assembly 14. The data acquisition unit 24 includes a spool 19 for storing the cable assembly 14 in coiled form. A motor 21 is operationally coupled to the spool 19 and can be operated to deploy and retract the cable assembly 14. The data acquisition unit 24 also includes optical signal processing equipment 26 that is communicative with the cable assembly 14. The data acquisition unit 24 can be housed on a trailer or other suitable vehicle thereby making the apparatus 10 mobile. Alternatively, the data acquisition unit 24 can be configured for permanent or semi-permanent operation at a wellbore site.

The apparatus 10 shown in FIG. 1 is located with the data acquisition unit 24 at surface and above an abandoned wellbore A with the cable assembly 14 deployed into and suspended within the wellbore A. While an abandoned wellbore is shown, the apparatus can also be used in producing wellbores, during times when oil or gas production is temporarily stopped or suspended. The cable assembly 14 spans a desired depth or region to be logged. In FIG. 1, the cable assembly 14 spans the entire depth of the wellbore A. The acoustic transducer array 16 is positioned at the deepest point of the region of the wellbore A to be logged. The wellbore A comprises a surface casing, and a production casing (not shown) surrounding a production tubing through which a gas or liquid hydrocarbon flows through when the wellbore is producing.

At surface, a wellhead B closes or caps the abandoned wellbore A. The wellhead B comprises one or more valves and access ports (not shown) as is known in the art. The fiber optic cable assembly 14 extends out of the wellbore 12 through a sealed access port (e.g. a 'packoff') in the wellhead 22 such that a fluid seal is maintained in the wellbore A.

Figure 2:
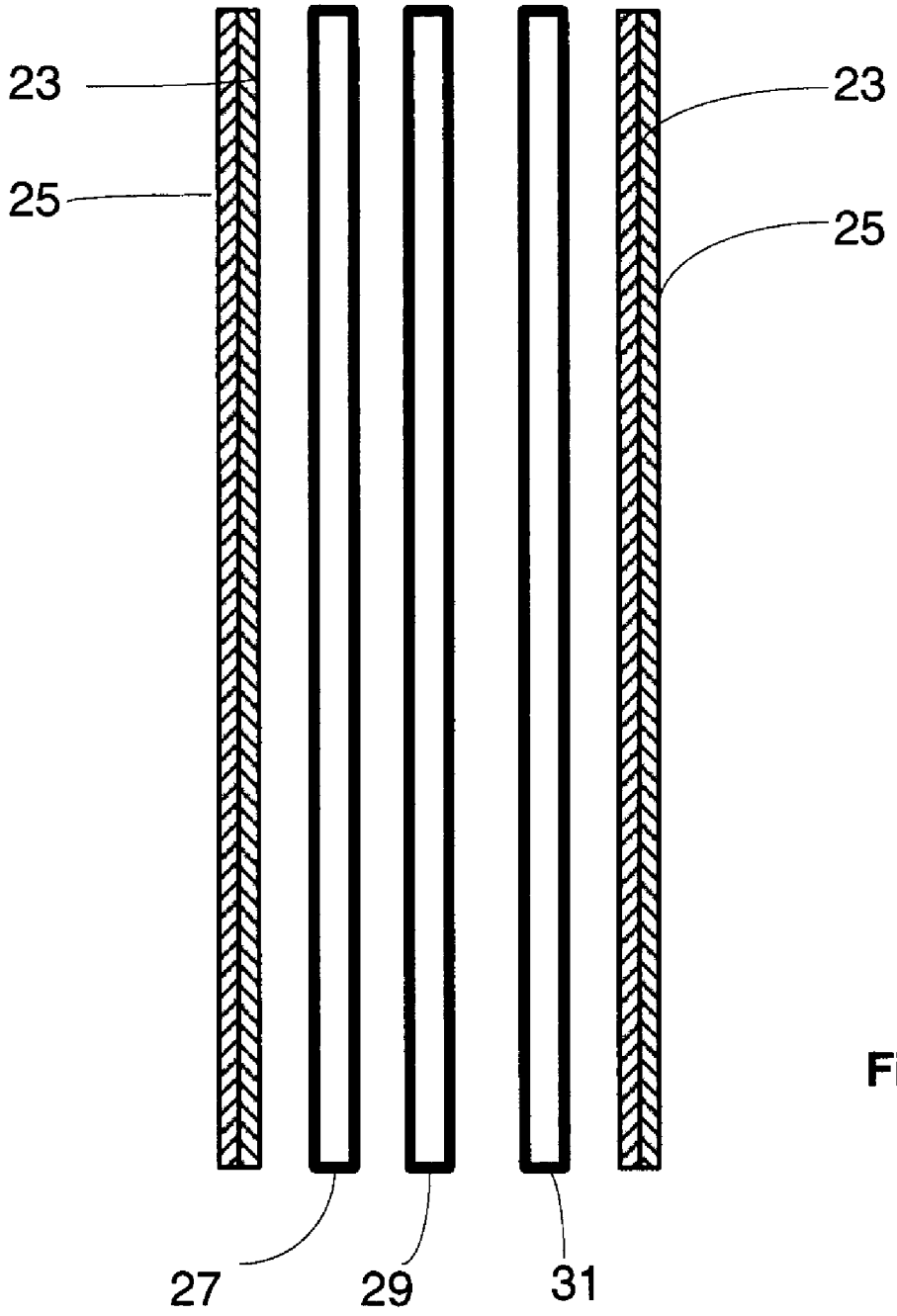
FIG. 2 is a schematic view of a fiber optic cable assembly of the gas migration detection and analysis apparatus.

Referring now to FIG. 2, the fiber optic cable assembly 14 comprises a fiber optic cable 15, comprising a plurality of fiber optic strands. The plurality of fiber optic strands may surround a core comprising a strength member, such as a steel core. The plurality of fiber optic strands (and core, if present are encased in a flexible protective sheath 23 surrounded by a flexible strength member and/or cladding 25. The plurality of fiber optic strands comprises at least two single mode optical fibers including a Coherent Raleigh ("CR") transmission line 27 and a digital noise array ("DNA") transmission line 31, and one or more multimode optical fibers extending the length of the cable 15 including a digital temperature sensing ("DTS") transmission line 29.

The optical fibers 27, 29 act as both a temperature transducer (29) and an acoustic transducer (27). Therefore, the sheath 23 and cladding 25 material are selected to be relatively transparent to sound waves and heat, such that sound waves are transmissible through the sheath 23 and cladding 25 to the CR transmission line 27 and the DTS transmission line 29 is relatively sensitive to temperature changes outside of the cable 15. Suitable materials for the sheath include stainless steel and suitable materials for the cladding include aramid yarn and KEVLAR™. Examples of such sheaths, their composition and methods of manufacturing are described in, for example, US Publication No: 2006/0153508, or US Publication No. 2003/0202762.

Optical fibers, such as those used in some aspects of the invention, are generally made from quartz glass (amorphous $SiO_2$). Optical fibers may be 'doped' with rare earth compound, such as oxides of germanium, praseodymium, erbium, or similar) to alter the refractive index, as is well-known in the art. Single and multi-mode optical fibers are commercially available, for example, from Corning Optical Fibers (New York). Examples of optical fibers available from Corning include ClearCurve™ series fibers (bend-insensitive), SMF28 series fiber (single mode fiber) such as SMF-28 ULL fiber or SMF-28e fiber, InfiniCor® series Fibers (multimode fiber)

Without wishing to be bound by theory, when light interacts with the matter in an optical fiber, scattering occurs (Raman scattering). Generally, three effects will be observed—Rayleigh scattering (no energy exchange between the incident photons and the matter of the fiber occurs—"Rayleigh band") Stokes scattering (molecules of the optical fiber absorb energy of the incident photons, causing a shift to the red end of the spectrum—"Stokes band") and anti-Stokes scattering (molecules of the optical fiber lose energy to the incident photons, causing a shift to the blue end of the spectrum—"anti-Stokes band"). The difference in energy of the Stokes and anti-stokes bands may be determined, as is well known in the art, by subtracting the energy of the incident laser light from that of the scattered photons.

As is exploited in DTS applications, the anti-Stokes band is temperature-dependent, while the Stokes band is essentially independent of temperature. A ratio of the anti-Stokes and Stokes light intensities allows the local temperature of the optical fiber to be derived.

As is exploited in CR applications, when an acoustic event occurs downhole at any point along the optical fiber employed for CR, the strain induces a transient distortion in the optical fiber and changes the refractive index of the light in a localized manner, thus altering the pattern of backscattering observed in the absence of the event. The Rayleigh band is acoustically sensitive, and a shift in the Rayleigh band is representative of an acoustic event down hole. To identify such events, a "CR interrogator" injects a series of light pulses as a predetermined wavelength into one end of the optical fiber, and extracts backscattered light from the same end. The intensity of the returned light is measured and integrated over time. The intensity and time to detection of the backscattered light is also a function of the distance to where the point in the fiber where the index of refraction changes, thus allowing for determination of the location of the strain-inducing event.

Figure 3:
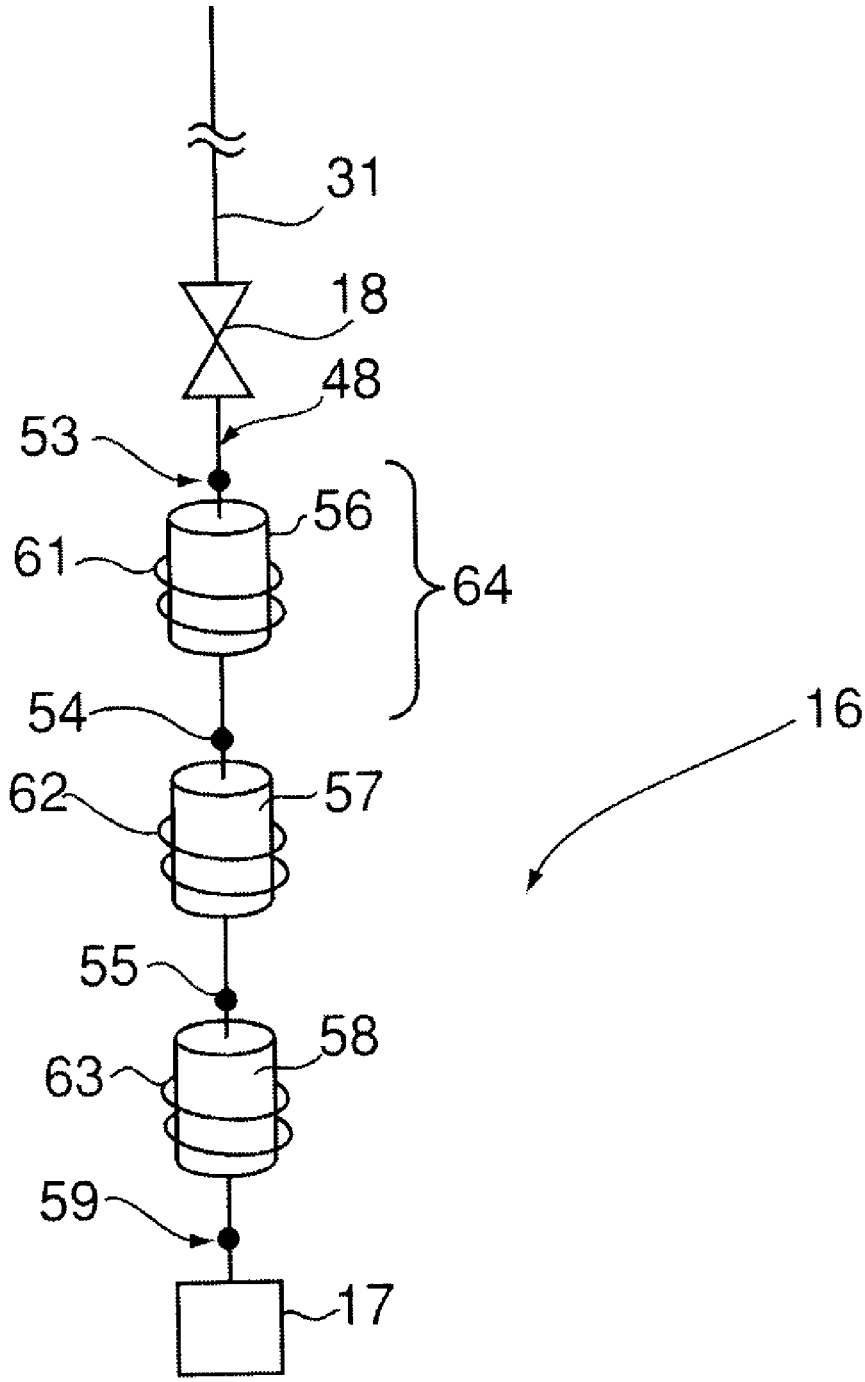
FIG. 3 is a schematic view of an acoustic transducer array of the fiber optic cable assembly.

Referring to FIG. 3, the DNA transmission line 31 is optically coupled to the acoustic transducer array 16 by the optical coupling 18. The DNA transmission line 31 is also in optical communication with the optical signal processing equipment 26, as described below. The array 16 comprises a plurality of Bragg gratings 53, 54, 55, 59 etched in a fiber optic line 48, separated by an intervening length of unetched fiber optic line 61, 62, 63. The intervening lengths of unetched fiber optic line 61, 62, 63 are individually wound about a mandrel 56, 57, 58. The weight 17 is attached at the distal end of the optical fiber. A transducer (e.g. 64) comprises a first Bragg grating (e.g. 53), an intervening length of unetched fiber optic line (e.g. 61) wound about a mandrel (e.g. 56) and a second Bragg grating (e.g. 54). The end of the fiber optic line 48 is terminated with an anti-reflective means as is know in the art. Methods of making in-fiber Bragg gratings are known in the art, and are described in, for example, Hill, K. O. (1978). "Photosensitivity in optical fiber waveguides: application to reflection fiber fabrication". *Appl. Phys. Lett.* 32: 647 and Meltz, G.; et al. (1989). "Formation of Bragg gratings in optical fibers by a transverse holographic method". *Opt. Lett.* 14: 823. A publication by Erdogan (Erdogan, T. "Fiber Grating Spectra". *Journal of Lightwave Technology* 15 (8): 1277-1294) describes spectral characteristics that may be achieved in fiber Bragg gratings, and provides examples of the variety of optical properties of such gratings. Generally, a small segment of the optical fiber is treated so as to reflect specific wavelengths of light, or ranges of light, and permit transmission of others and/or to act as a diffraction grating (acting as an optical filter). The small size of the etched area of a fiber-Bragg grating sensor allows close spacing in an array. The fiber-Bragg grating sensors may be positioned a few centimeters apart, for example about 5 to about 10 centimeters apart, giving a dense dataset for the region of the wellbore being logged. Alternatively, a plurality of different fiber-Bragg grating sensors tuned for a variety of frequencies or ranges of frequencies (properties) may be clustered a few centimeters apart, and the cluster repeated a greater distance apart.

An array according to some embodiments of the present invention has a plurality of transducers. For example, the array may have at least 2, at least 3, at least 4, at least 5, at least 10, at least 20, at least 30, at least 40, at least 50, at least 100, at least 200, or more transducers. For a large array having many tens or hundreds of transducers, for example an array used in a deep well (2000 meters or more, for example), the weight of the cable and transducers may necessitate use of a core or sheath structure, or other configuration that imparts mechanical strength.

In another embodiment, the array comprises at least two transducers at each of at least two positions. For example, in an array having 20 transducers (a 20-component array), the transducers may be arranged in a transducer cluster having two sensors, each transducer cluster being spaced 2 meters apart from the adjacent pair.

The spacing of the transducers is preferably 1.5 meters but can anywhere in a range between 0.1 to about 10 meters. The individual Bragg gratings are considered single-point sensors. The mandrel or core around which the intervening length of optical fiber is wound is the sensing element or mechanism. It is about 10 inches long and generally cylindrical. The mandrel may be of any suitable length and diameter combination, and the diameter and/or length may be longer to accommodate a greater intervening length of fiber optic cable. The core may be comprised of any suitable material or combination of materials that cooperate to provide the desired effect. Examples include rubbers of various durometer, elastomers, silicones or other polymers, or the like. In other embodiments, the core may comprise a hollow shell filled with a fluid, an acoustic gel, or an oil, or a solid or semi-solid medium capable of transmitting or permitting passage of the relevant frequencies. The relevant frequencies may be generally in the range of 20-20,000 kHz. Selection of core size, composition, arrangement of the cable on the core (i.e. number of windings, density or spacing of winding, etc) is within the ability of one skilled in the relevant art. Without wishing to be limited by theory, wrapping or winding the intervening length of fiber optic cable between a first and a second fiber-Bragg grating around a core may increase the amount of fiber optic cable sensing the signal due to the increase in effective fiber cross section axially along the sensing area. The core may act as an 'amplifier' of the change in pressure in response to fluid migration. Distortion of the core in response to change in pressure conveys the distortion to a greater length of the sensing fiber, thus increasing the distortion to be detected by an interferometer and allow detection of a pressure change that would not otherwise be reliably differentiated over background noise. In some embodiments, the composition and dimensions of the mandrel and degree of wrapping of optical fiber wrapped about the mandrel may allow for selective blocking or reduction of sensitivity to acoustic signals above, below, or within a particular frequency range, thus fulfilling a role as a physical bandpass filter.

Figure 4:
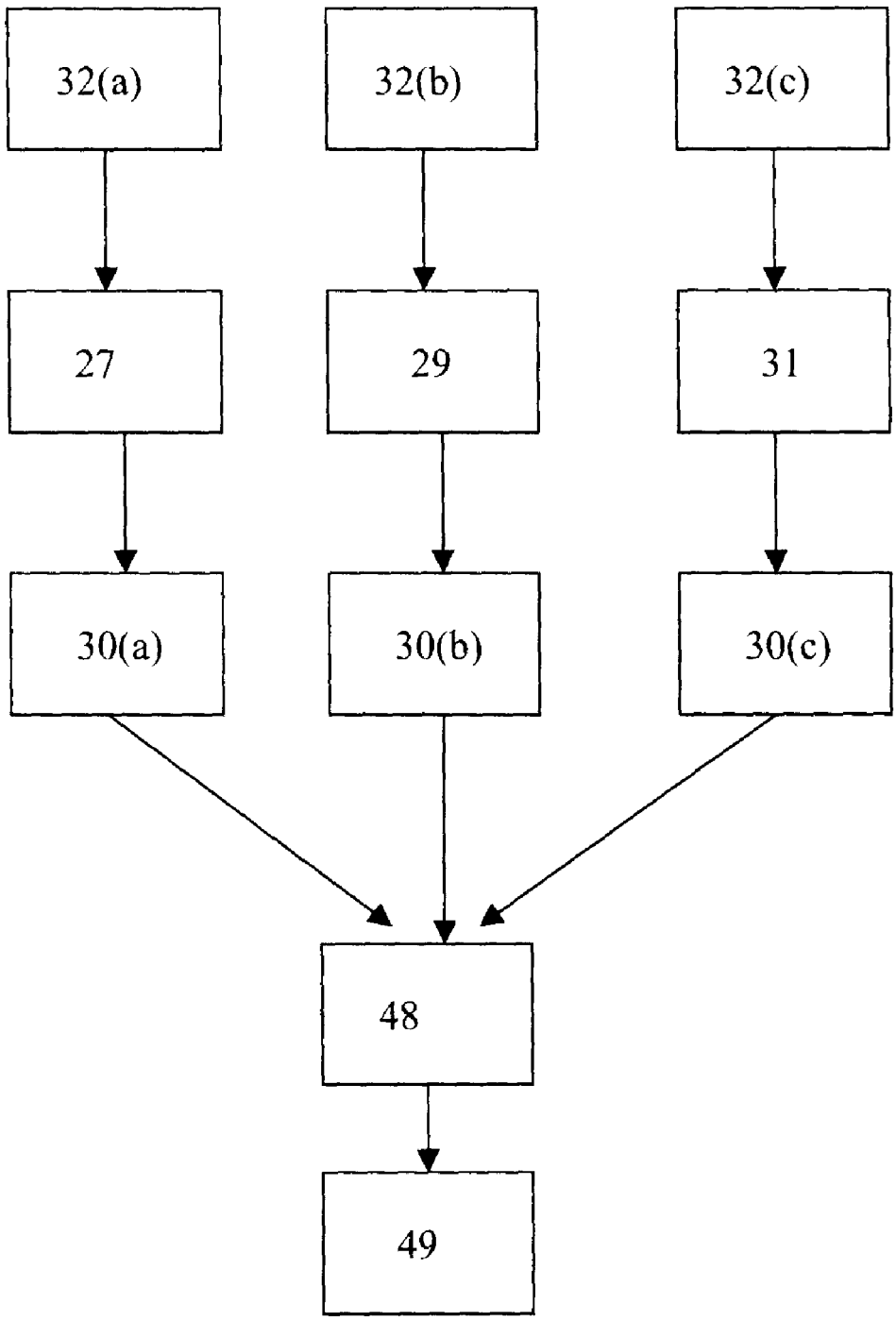
FIG. 4 are functional block diagram of certain components of the cable assembly and transducer array.

Referring now to FIG. 4, the apparatus 10 also includes optical signal processing equipment 26 which is communicatively coupled to the CR, DTS and DNA transmission lines 27, 29, 31. The optical signal processing equipment 26 includes three laser light assemblies 32(*a*), (*b*), (*c*), and three demodulating assemblies 30(*a*), (*b*), (*c*).

Figure 5:
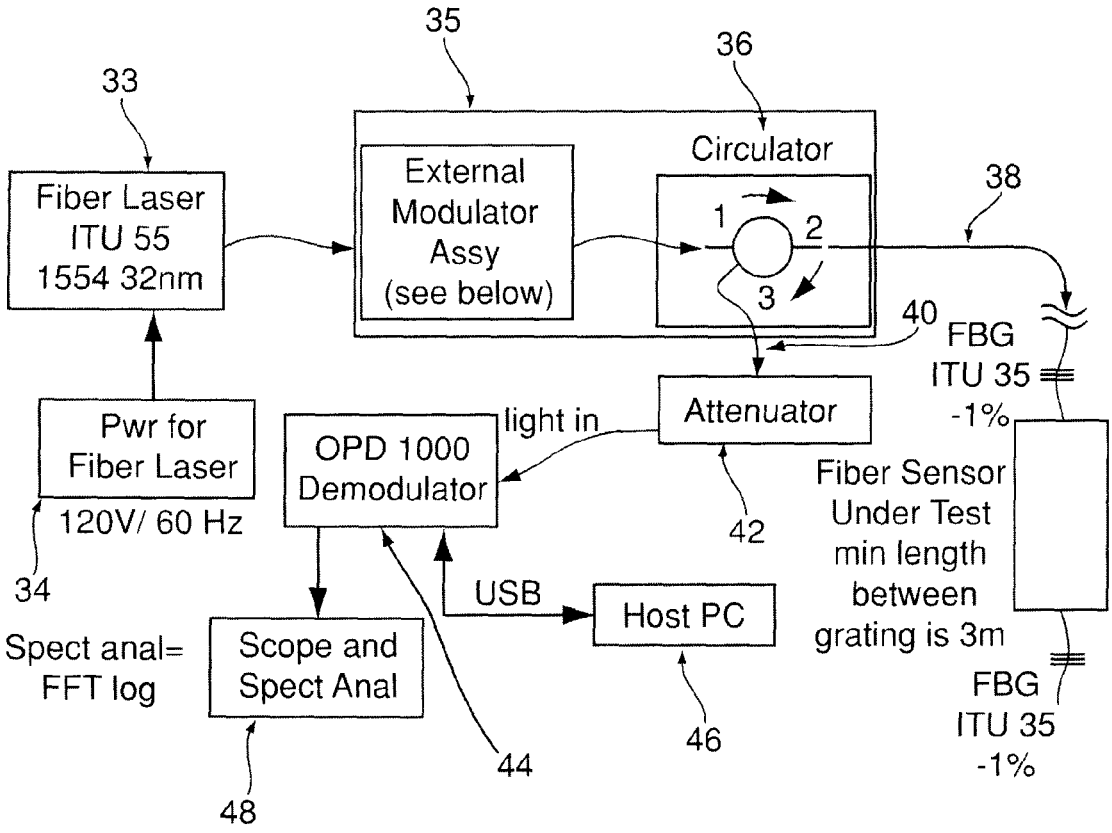
FIG. 5 is a functional block diagram of components of an optical signal processing assembly of the gas migration detection and analysis apparatus.

Referring now to FIG. 5, each laser light assembly 32(*a*), (*b*), (*c*) has a laser source 33, a power source 34 for powering the laser source 33, an external modulator 35 having an input optically coupled to the output of the laser source 33, a circulator 36 having an input optically coupled to an output of the modulator 35 and an input/output 38 optically coupled to one of the transmission lines 27, 29, 31. Each circulator 36 also has an output 40 optically coupled to an attenuator 42 of the demodulating assembly 30(*a*), (*b*), (*c*). Each demodulating assembly 30(*a*), (*b*), (*c*) has the attenuator 42, which in turn is optically coupled to a demodulator 44. Each demodulator 44 is electronically coupled to a digital signal processor 46 for signal processing and digital filtering and then to a host personal computer (PC) for data processing and analysis.

The laser source 33 can be a fiber laser powered by 120V/60 Hz power source 34. A suitable such laser has an output wavelength in the range from about 1300 nm to about 1600 nm, e.g. from about 1530 to about 1565 nm. Laser sources suitable for use in with the apparatus described herein may be obtained from, for example, Orbits Lightwave Inc (Pasadena Calif.).

Figure 6:
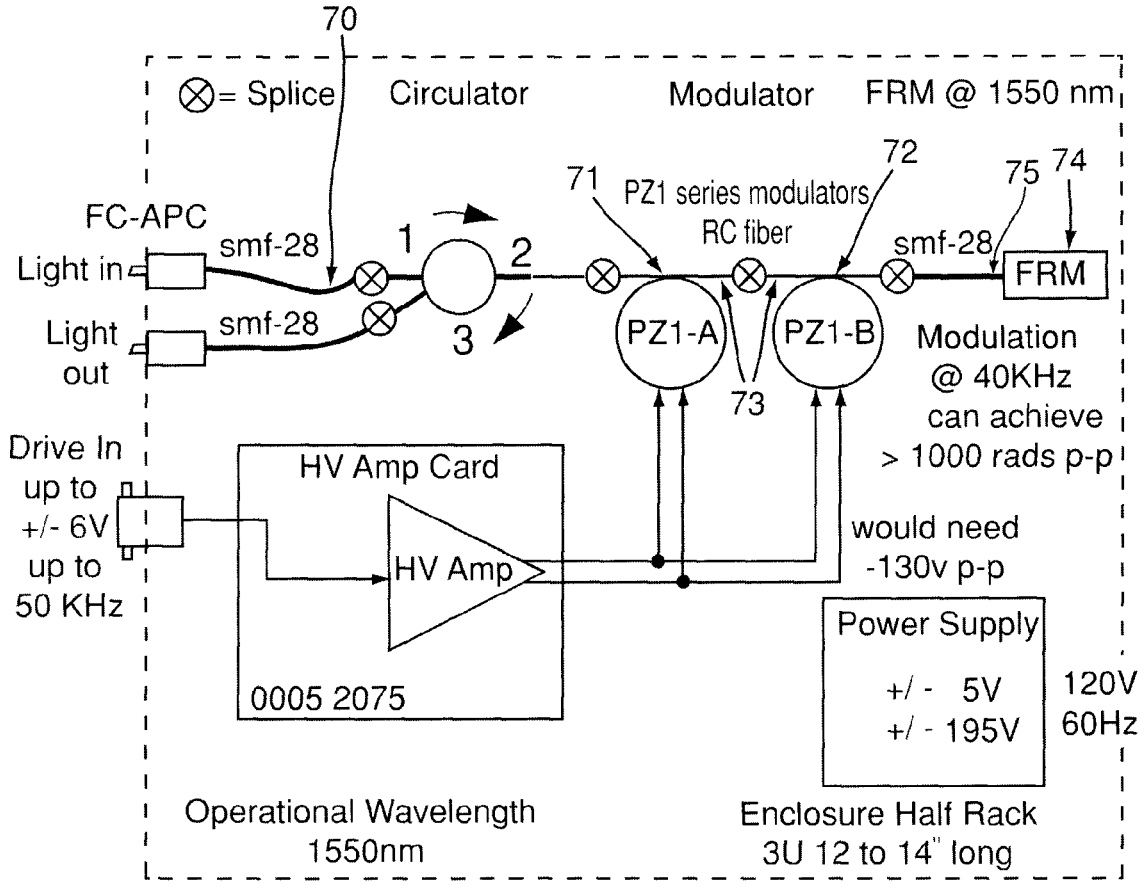
FIG. 6 is a functional block diagram of certain components of the external modulator assembly 35 of FIG. 5.

The external modulator 35 is a phase modulator for the laser source 33. Components of an external modulator 35 are illustrated in FIG. 6. Light from the laser source 33 is conveyed to a circulator 36 via optical fiber 70. The circulator 36 is in optical communication with first 71 and second 72 fiber stretchers (e.g. Optiphase PZ-1 Low-profile Fiber Stretcher) via spliced RC fiber 73. Further optically coupled to the circulator 36 and fiber stretchers 71, 72 is an FRM @ 1550 nm 74; via optical fiber 75 spliced to RC fiber 73. Modulation of such a system at 40 kHz with ~130 V peak power may be used.

The circulator 36 controls the light transmission pathway between a respective laser light assembly 32(*a*), (*b*), (*c*), transmission line 27, 29, 31 and demodulator assembly 30(*a*), (*b*), (*c*). When a light pulse from the laser light source is to be directed into the transmission line, the circulator 36(*a*), (*b*), (*c*) is selected so that a light transmission path is defined between the external modulator 34(*a*), (*b*), (*c*) and the transmission line 27, 29, 31. When reflected light in the transmission line 27, 29, 31 ("leak measurement data") is to be detected, the circulator 36 is selected so that a light transmission path is defined between the transmission line 27, 29, 31 and the attenuator 42.

The attenuator 42 is a Mach-Zehnder interferometer, which is a device used to determine the phase shift caused by a sample which is placed in the path of one of two collimated beams (thus having plane wavefronts) from a coherent light source. Such a device is well known in the art and thus not described in detail here.

The optical phase demodulator 44 is an instrument for measuring interferometric phase of the leak measurement data from the transmission lines 27, 29, 31. The demodulator may be, for example, a digital signal processor-based large angle optical phase demodulator that performs demodulation of the optical signal output from the attenuator 42.

The demodulated electronic signal from the demodulator 30*a, b, c* is input into a first digital signal processor 48. Encoded on of the digital signal processor 48 are digital signal processing algorithms including a Fast Fourier Transform (FFT) algorithm. The processor 48 applies the FFT to the signal to pull out the frequency components from background noise of the leak measurement data.

In an alternate embodiment An Optiphase PZ2 High efficiency fiber stretcher may be used instead of the PZ1; If the PZ2 is used with the RC fiber as shown, modulation at 20 kHz with 30 V peak power may be used.

An example of a component of the data acquisition unit that may be useful in the apparatus and methods described herein is the OPD4000 phase modulator (Optiphase Inc.; Van Nuys, Calif.).

The data output from the processor 48 is then input into a second digital signal processor 49. The second processor 49 has a memory with an integrated software package encoded thereon ("software"). The software receives the raw leak measurement data from the digital signal processor 48, processes the data to obtain a gas migration profile of the wellbore A and displays the data in a user readable graphical interface. As will be discussed in detail below under "Software", the software obtains the gas migration profile by subtracting a static profile of the wellbore A from a dynamic profile of same. Both static and dynamic profiles are measured by the apparatus 10.

The apparatus and equipment described above may be housed in the data acquisition unit 24 in a conventional manner. In some embodiments each of the apparatus for CR, DTS and DNA are operated independently of one another, and are provided with separate components—laser source, power supply, external modulator, demodulator, host PC, oscilloscope and first and second processors and the like. Alternately, some or all of the components for each of the CR, DTS and DNA logging may be shared, for example, there may be a single laser source with a splitter to provide the appropriate wavelength of light suited for each application. In some embodiments, it may be advantageous to process the datasets in one processor, or in a series of processors in communication with one another, to enable time-synchronous data to be more accurately obtained.

The data acquisition unit 24 may comprise hardware and software suitable for the operation of the data acquisition unit, including the steps and methods described below. Computer hardware components include central processing unit (CPU), digital signal processing units, computer readable memory (e.g. optical disks, magnetic storage media, flash memory, flash drive, solid state hard drive, or the like), computer input devices such as a mouse or other pointing device, keyboard, touchscreen; display devices such as monitors, printers or the like.

Operation

The apparatus 10 is operated to obtain static and dynamic profiles of the wellbore A using CR, DTS and DNA techniques.

Figure 7:
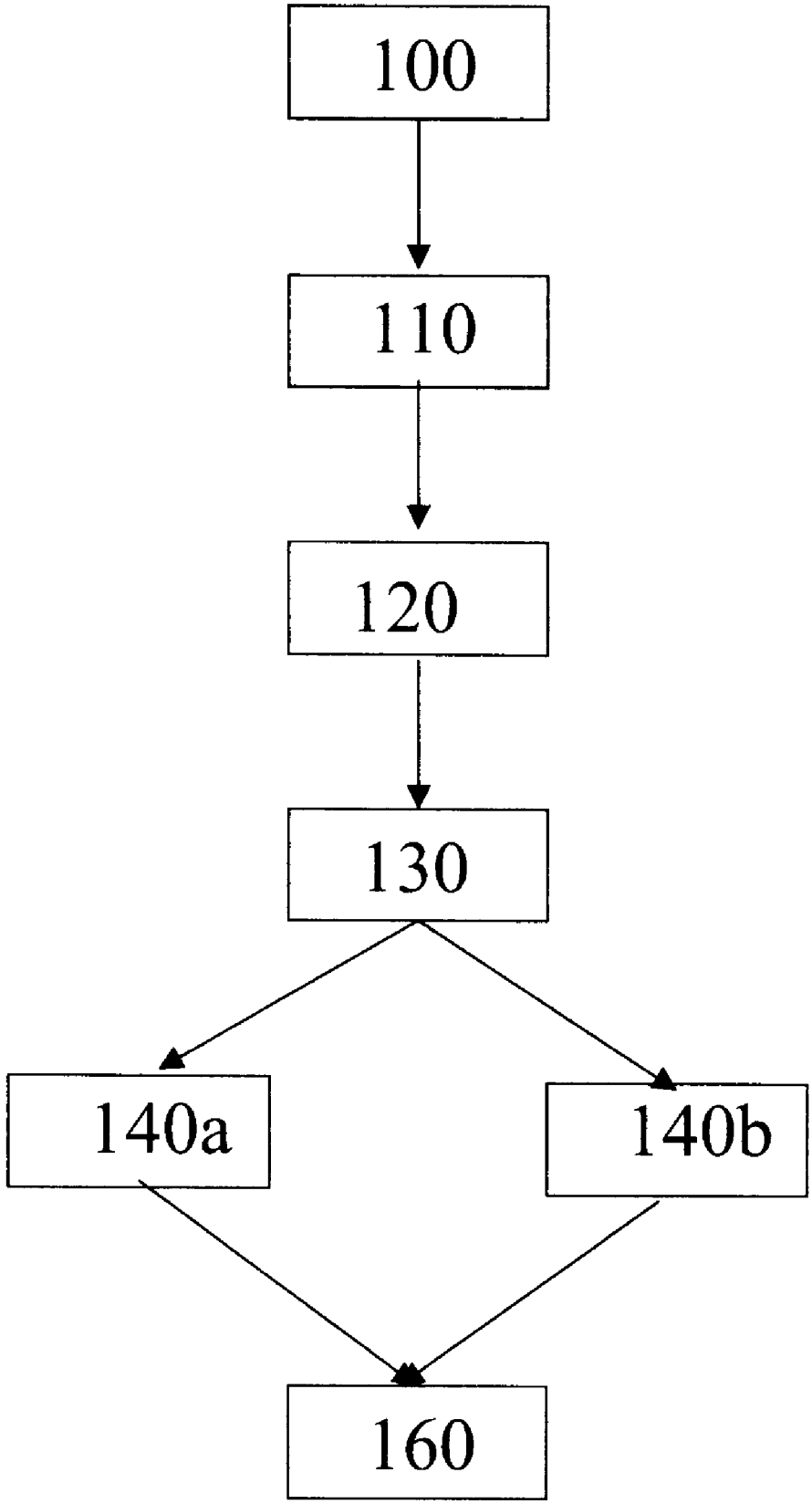
FIG. 7 is a flowchart of steps for determining the static profile of a wellbore using the apparatus of FIG. 1.

Referring to FIG. 7, the static profile of the wellbore A is obtained as follows:

Step 100: Place fiber optic cable assembly 14 (including array of fiber optic transducers 16) in the wellbore A at a first location (e.g. bottom of well, or most distal point), spanning the region to be logged ("logging region");

Step 110: Pressurize wellbore A (close vent or apply positive atmospheric pressure e.g. pump air down it) and allow to equilibrate (hours to days, depending on the well, nature of fluid leak, etc.). Without wishing to be bound by theory, acoustic events related to fluid migration will cease when the well is pressurized (sealed and allowed to equilibrate, or positively pressurize, or a combination of both, depending on the circumstance). Acoustic events unrelated to fluid migration (e.g. aquifer activity) will not cease when the well is sealed or pressurized, and can be identified as such in the static profile.

Step 120 Operate laser light assemblies 32(*a*), (*b*), (*c*) to send laser light down each of the CR, DTS and DNA transmission lines 27, 29, 31 and:

(a) collect static CR data over logged region (time series);

(b) collect static DTS data over logged region (time series);

(c) collect static DNA data of first array span of logged region (time series), using acoustic transducer array 16 by:

(i) raising array by one array span, collect static acoustic data of second/subsequent array span of logged region (time series);

(ii) repeating for entire length of logged region;

Step 130: Operate demodulating assemblies 30(*a*), (*b*), (*c*) to demodulate collected static CR/DTS/DNA signal data and measure the interferometric phase of same.

Step 140*a*: Apply the FFT to the demodulated CR/DNA signal data to extract the frequency components from background noise in the data.

Step 140*b*: Integrate DTS data series over time (small occurrences become amplified—for example, a temperature change due to a leak may not be large for any one sampling, over time (e.g. sampling each second, or microsecond) the small changes 'add up').

Step 160: Output—'static profile' for each of CR, DTS and DNA datasets spanning logged region of the wellbore A.

Either of step 140*a* or 140*b* is included in the method, dependent on the data to be processed.

In step 120, static CR data is collected by pulsing laser light of defined wavelength from the laser source down the CR transmission line 27 (an optical fiber), which is reflected back in a pattern intrinsic to the optical fiber. When an acoustic event occurs downhole at any point along the CR transmission line 27 the strain on the optical fiber induces a distortion event in the retransmitted later light and this distortion event is identifiable by the demodulator 30(*a*) as a variant in the pattern. The scattering of the light (Raman scattering) in response to the variants in the optical fiber 27 provides back (in response to the initial single wavelength of light sent down) a set of peaks at several wavelengths, one of which is similar to the initial wavelength sent down (Rayleigh band) and is 'acoustically sensitive' if interrogated in a suitable manner. This is the Coherent Raleigh wavelength.

In step 120, static DTS data is collected by pulsing laser light of a defined wavelength and frequency down the DTS transmission line 29 (an optical fiber), which is reflected back in a pattern intrinsic to the optical fiber. Temperature is measured by the transmission line 29 as a continuous profile (optical fiber 29 functions as a linear sensor). A localized temperature change in the wellbore A will be measurable as a distortion in the fiber optic in the vicinity of the temperature change. The resolution of the DTS transmission line 29 is generally high—spatially about 1 meter, with accuracy within ~1 degree C., and resolution of ~0.01 degree C. In some embodiments, the temperature range being detected may be from about zero degrees to above 400 degrees Celsius or more, or from about 10 degrees Celsius to about 200 degrees Celsius, or any range therebetween; or may be a more moderate range from about 10 degrees Celsius to about 150 degrees Celsius, or any range therebetween; or from about 20 degrees Celsius to about 100 degrees Celsius; or any range therebetween. Such "distributed temperature sensing" is known in the art (see, for example, Dakin, J. P. et al.: "Distributed Optical Fibre Raman Temperature Sensor using a semiconductor light source and detector"; Electronics Letters 21, (1985), pp. 569-570; WO 2005/054801 describes improved methods for DTS generally. and thus not discussed in any further detail here.

Optical time domain reflectometry (OTDR) is well known in the art for use with DTS to determine the location of temperature changes, and thus not discussed in any further detail here. See, for example, Danielson 1985 (Applied Optics 24(15):2313) for a description of OTDR specifications and performance testing In step 120, static DNA data is collected by pulsing laser light of a defined wavelength and frequency down the DNA transmission line 31 (an optical fiber) to the acoustic transducer array 16. The array 16 comprises a plurality of Bragg gratings, each having a characteristic reflection wavelength (the frequency to which it is 'tuned') about which it serves as an optical filter. In the absence of a strain-inducing event (e.g. acoustic event) the returned light reflection is 'background' or steady state (a different wavelength for each grating). When an event occurs, strain causes distortion and the reflected light pattern varies at the gratings closest to the event (or those most affected by it e.g. the greatest amplitude of strain.)

Figure 8:
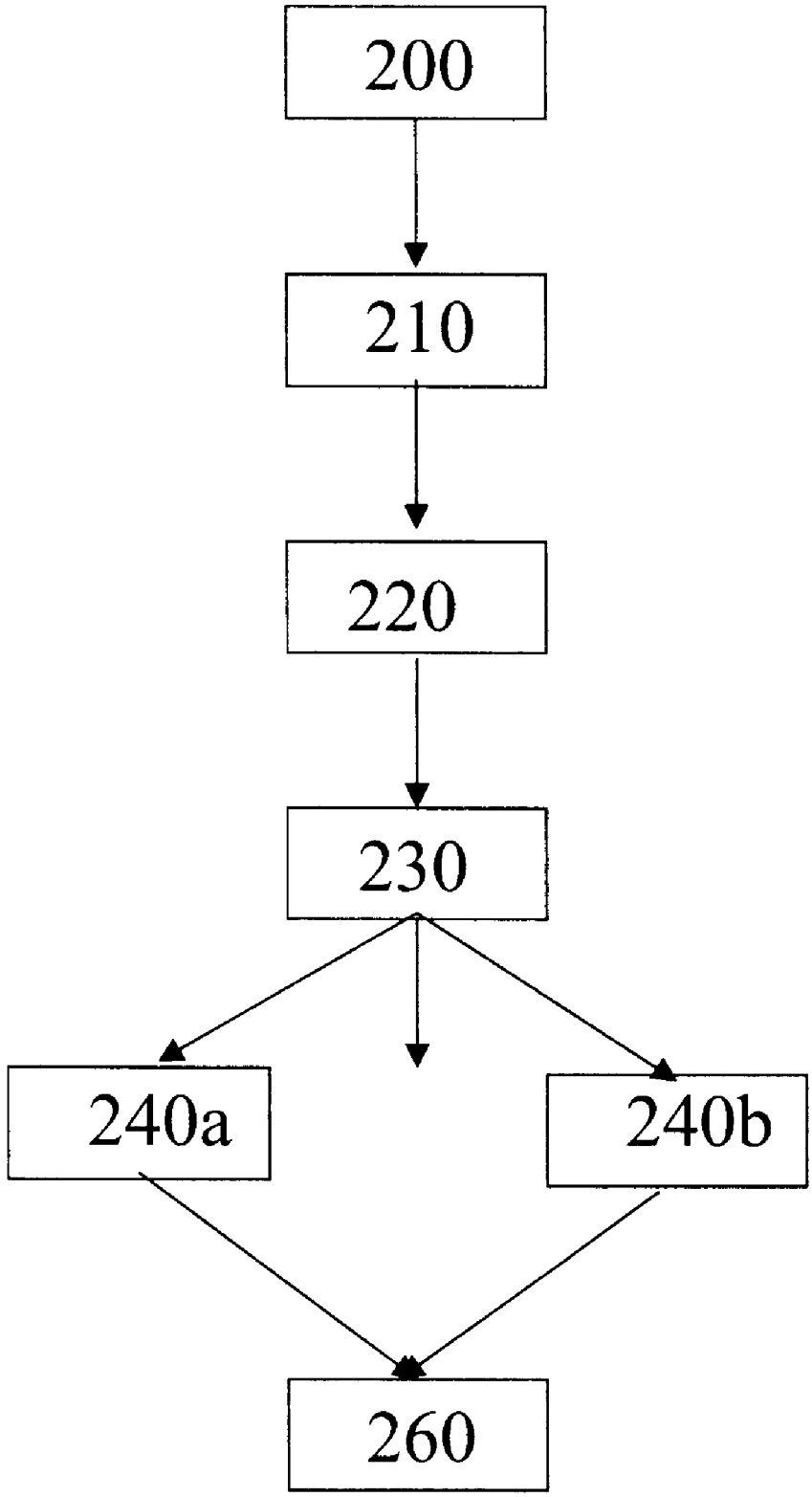
FIG. 8 is a flowchart of steps for determining the dynamic profile of a wellbore using the apparatus of FIG. 1
Figure 9:
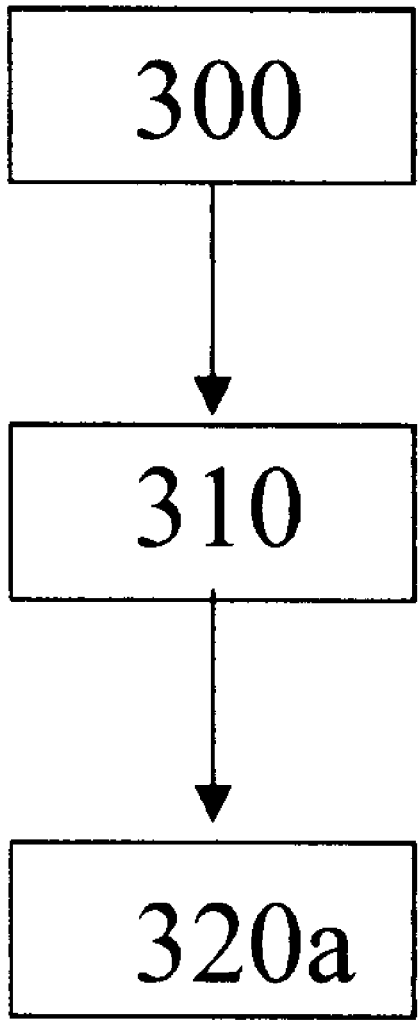
FIG. 9 is a flowchart of steps for determining the fluid migration profile of a wellbore using methods according to some aspects of the invention.

Referring to FIG. 8, the dynamic profile of the wellbore A is obtained as follows:

Step 200: Following acquisition of static CR, DTS and DNS data, reposition fiber optic cable assembly at the first location, spanning the logging region;

Step 210: Open vent of wellbore and allow fluid migration to resume; any leaking fluid will flow and the bubbles will generate noise and/or temperature anomalies e.g. cold spots due to gas expansion in an otherwise largely linear geothermal temperature gradient (increasing with depth). Alternately, a negative atmospheric pressure may be applied (a vacuum) to stimulate fluid migration. Other gas formations or aquifers may also cause temperature anomalies—a 3D geophysical map of the region (usually done as part of the exploration process when determining where to place the well and how deep) would indicate the location of known aquifers and may be used to identify temperature and/or acoustic anomalies in the CR and DTS data streams as being unrelated to a leak. Alternately, an aquifer may have a temperature and acoustic profile that differs significantly from that of a fluid migration event, and be specifically identified on the basis of a temperature/sound profile;

(a) collect dynamic CR data over logged region;

(b) collect dynamic DTS data over logged region;

(c) collect DNA data of first array span of logged region, using acoustic transducer array 16 by:

(i) raising array by one array span, collect dynamic acoustic data of second/subsequent array span of logged region;

(ii) repeating for entire length of logged region;

Step 230: Operate demodulating assemblies 30(*a*), (*b*), (*c*) to demodulate collected static CR/DTS/DNA signal data and measure the interferometric phase of same.

Step 240*a*: Apply the FFT to the demodulated CR/DNA signal data to pull out the frequency components from background noise in the data.

Step 240*b*: Integrate DTS data series over time (small occurrences become amplified—for example, a temperature change due to a leak may not be large for any one sampling, over time (e.g. sampling each second, or microsecond) the small changes 'add up'

Step 260: Output—'dynamic profile' for each of CR, DTS and DNA datasets spanning logged region of wellbore.

Either of step 240*a* or 240*b* is included in the method, dependent on the data to be processed.

Again, for each station log(step 210 (*c*)(*i*)), acoustic samples may be collected at least in duplicate, preferably in triplicate (e.g., three 30-second acoustic samples for each array span). Each acoustic sample is assessed for quality and similarity to the other sample(s). If the samples demonstrate sufficient similarity, the data is considered to be 'valid' and the array is raised and the acoustic sampling repeated. Similarity is assessed as described for the static profile.

For each DNA log step (step 120 (*c*)(*i*) or step 210 (*c*)(*i*)), acoustic samples may be collected at least in duplicate, preferably in triplicate (e.g., three 30-second acoustic samples for each array span). Each acoustic sample may span a time interval ranging from about 1 second to about 1 hour, to about 8 hours or more if desired. Preferably, the time interval is from about 10 seconds to about 2 minutes, or from about 30 seconds to about 1 minute. In an array having a larger number of transducers, a longer array span may be sampled at each step, thus decreasing the number of steps required to cover the logged region.

Each acoustic sample is assessed for quality and similarity to the other sample(s). If the samples demonstrate sufficient similarity, the data is considered to be 'valid' and the array is raised and the acoustic sampling repeated.

Similarity between samples may be judged by the operator, or may be assessed statistically. For example, samples may be considered to demonstrate sufficient similarity if the difference between them is not statistically significant. As another example, when acoustic data is sampled, the periodic nature of a bubble is identifiable when the pressure is released (e.g. as per step 210 above). A sporadic event such as the fiber optic cable or other component of the fiber optic assembly contacting or striking the side of the casing would not be expected to repeat itself periodically either in the static or dynamic profile. The irregularity of such sporadic events, and/or the regularity of a bubble of fluid migrating allows for identification or differentiation of such events from those of the migrating fluid. In the event that a sample is considered to be not 'valid', repetition of the acoustic sampling may be prompted.

Any of several known multiplexing techniques may be used to differentiate the signal received from each individual grating in the transducer array 16. Wavelength division multiplexing (WDM) and time division multiplexing (TDM) are both useful. Time to return to the surface is how the controlling software 'knows' where the acoustic event is occurring. For example, signals coming back from the fiber in between gratings 53 and 54 will be returned sooner than those coming back from gratings 55 and 59.

With respect to determination of physical location of the array, the length of the overall fiber optic cable assembly (14) is known, including the array of fiber optic transducers (16). For example, in a system with an overall length of 2000 meters, one will always get a signal trace that is 2000 m long (inclusive of the cable wound on the spool). The controlling software is in communication with the data acquisition unit 24, and records the length of cable deployed—thus the depth at which the array 16 is deployed is known, as is the relative spacing between each of the Bragg gratings. The section of the temperature or acoustic profile that corresponds to the section of the fiber optic assembly remaining on the spool is subtracted from the profile when the data is processed (see "Software" section below, for further details).

Use of digital signal processing technology, removes the dependence on analog filters, circuits and amplifiers, providing an enhanced signal-to-noise ratio, which in turn may increase the accuracy of fluid migration detection. Additionally, digital signal processing enables 'real-time' processing of the resulting data, and the reduced bandwidth requirements allow for use of multiple transducers. An array of transducers allows for enhanced accuracy in pinpointing the location of the leak, as spatial calculations may be performed, comparing amplitude variations and time lapse in the signal between the different transducers to determine the position of the leak relative to the array.

In summary, the transducer in the DNA noise array (the mandrel+optical fiber+pair of Bragg gratings), or the optical fiber for CR, is converting an acoustic signal into an optical signal; in DTS, the optical fiber is also the transducer and it is a temperature change that is converted into an optical signal; the optical signal is transmitted to the phase modulator which converts the optical signal into an electronic representation of the acoustic signal or temperature change; the electronic representation of the acoustic signal is subjected to an FFT; while the temperature change data is integrated over time. The resulting transformed or integrated is the static profile or dynamic profile of the wellbore for CR/DTS/DNA measurements fed to the software for processing to obtain the fluid migration profile.

During operation, signals or data may be received continuously during sampling and repositioning steps, or selectively, for example, only during monitoring steps Integrated Software Package The software comprises steps and instructions for (1) obtaining a fluid migration profile of a wellbore, and (2) differentiating or identifying events in the obtained fluid migration profile. The software obtains a fluid migration profile by subtractive filtering of a static profile from each of the CR, DTS and DNA datasets of a wellbore against a dynamic profile of same. The static and dynamic profile datasets are collected by the apparatus 10 in a manner as described in detail below.

Subtractive filtering removes or cancels out elements and events common to both the static and dynamic profile on the basis that such common elements and events represent environmental non-fluid migration elements and events. The remaining data thus represents the fluid migration profile of each of the CR, DTS and DNA datasets.

The software also differentiates or identifies events in the obtained fluid migration profile, as follows:

Step 300: S static profile for each of CR, DTS and DNA is subtracted from the dynamic profile of each of CR, DTS and DNA datasets spanning the logged region of the wellbore, to obtain the fluid migration profile of the logged region of the wellbore.

Step 310: CR fluid migration profile is compared with each of DTS fluid migration profile and DNA fluid migration profile.

Step 320*a*: CR, DTS and/or DNA fluid migration profiles compared with other well logging profiles, 3D geophysical map data, cement bond condition or the like.

The subtraction of the CR, DTS and DNA static profiles from the CR, DTS, and DNA dynamic profile is a digital filtering step, and removes frequency elements form the dynamic profile that are also represented in the static profile, thus may be considered to be 'background' noise (noise refers to background signals generally, including temperature elements, not only acoustic events). For a feature in a fluid migration profile to be considered representative of a leak, the feature ideally is present only in the dynamic profile. For example, an acoustic event detected at a depth common to both static and dynamic profiles would be filtered out in step 300. As another example, an acoustic event at a particular depth in the well (as determined by the DNA fluid migration profile), should coincide with a temperature aberration at a similar depth in the DTS fluid migration profile.

The resulting fluid migration profile may be stored on a computer-readable memory for later access or manipulation Therefore, some embodiments of the invention provide for a method for obtaining a fluid migration profile for a wellbore, comprising the steps of a) obtaining a static profile for the logged region of the wellbore; b) obtaining a dynamic profile for the logged region of the wellbore and c) digitally filtering said dynamic profile to remove frequency elements represented in said static profile, to provide a fluid migration profile.

Some embodiments of the invention further provide for a computer readable memory or medium having encoded thereon methods and steps for obtaining a fluid migration profile for a wellbore, comprising the steps of a) obtaining a static profile for the logged region of the wellbore; b) obtaining a dynamic profile for the logged region of the wellbore and c) digitally filtering the dynamic profile to remove frequency elements represented in the static profile, to provide a fluid migration profile.

Some embodiments of the invention further provide for an apparatus for obtaining a fluid migration profile for a wellbore, comprising: a) a fiber optic cable assembly and data acquisition unit for obtaining a transformed static profile and a transformed dynamic profile for a logged region of the wellbore; b) a filter for digitally filtering said transformed dynamic profile to remove frequency elements represented in said static profile; and c) a computer-readable memory for storing said fluid migration profile. Some embodiments of the invention further provide for A computer program product, comprising: a memory having computer readable code embodied therein, for execution by a CPU, for receiving demodulated optical data obtained from a static profile and a dynamic profile of a wellbore, said code comprising: a) a transformation protocol for transforming demodulated data; b) an integration protocol for integrating demodulated data over time; and c) a digital filtering protocol for digitally filtering the dynamic profile to remove frequency elements represented in the static profile, to provide a fluid migration profile.

The co-occurrence (spatially and/or temporally) of patterns of temperature changes and acoustic events in a well bore provides for fluid ingress or egress rates, locations and in some embodiments of the invention, differentiation between types of fluids (gas or liquid hydrocarbon, gas or liquid water, or combinations thereof).

Other well logging profiles for the wellbore being logged may also be compared with the CR, DTS or DNA fluid migration profiles. Examples of such well logging profiles include cement bond logging (CBL), Quad Neutron Density logging (QND), or the like.

Quad Neutron Density (QND) logging allows evaluation of the casing formation through-casing (e.g. equipment is deployed within the wellbore and provide information about the surrounding geological strata) and may be useful for assessing at localized changes in the strata (density of the strata, etc) that may be correlated with geophysical maps and chemical sampling to identify strata types that have a higher incidence of leaks (e.g. less stable, loose sand vs solid rock, etc).

When the fluid migration profiles, 3D geophysical map information, cement condition profiling (CBL) and the like are aligned by depth in the wellbore, various fluid migration profile features may be correlated with known geophysical elements, other non-leak associated events or features, leaks, and in some situations, the nature of the leaking fluid. For example:

- identification of an aquifer at the same depth position as a drop in temperature and/or an acoustic event in the DNA may be identified by the algorithm as not being associated with a leak;
- a temperature change/drop (DTS) in the absence of an aquifer or acoustic events (DNA) at a similar depth may be indicative of a gaseous fluid leak;
- an acoustic event in the absence of a temperature change or aquifer at a similar depth may be indicative of a liquid fluid leak, or another seismic event.

Such "other" seismic events could be correlated with natural seismic activity in the area, or artificial seismic activity associated with exploration in the area (e.g. not a leak, just background noise, vehicle traffic).

The regularity of the acoustic event (periodicity) is also an indicator of a gaseous fluid leak—bubbles moving regularly.

The periodicity of a leak may be differentiated from other periodic acoustic events by applying a partial vacuum to the wellbore—the periodicity and/or amplitude of the acoustic event could be expected to increase for a periodic event associated with a leak. Frequency analysis may be useful to differentiate a bubble-related event from other non-fluid migration events.

Software could make these simple comparisons; software also provides visual output. (aligned graphs, sliding window to view regions of the depth profile of the various datasets simultaneously, numerical output of identified events, etc).

In some conditions, water, gas, steam or liquid hydrocarbons may emit different acoustic frequencies as they migrate through or around restrictions in the casing, wellbore or surrounding strata.

The software also includes steps for correlating the identification of a temperature or acoustic event with a depth in the wellbore. For CR determination of the point at where the index of refraction changes (the furthermost point of the optical fiber if it is 'undisturbed', or at the point of an event that induces strain in the fiber). When an acoustic event occurs downhole at any point along the CR optical fiber (e.g. above the array segment) the strain on the optical fiber induces a distortion event in the retransmitted later light and this distortion event is identifiable by the demodulator as a variant in the pattern compared to the 'static profile'.

In the event that the fiber optic cable does not deploy 'straight down' the wellbore (e.g. kinks or curls in the cable), correlating the features of the static, dynamic and/or fluid migration profile of the wellbore with known geophysical data may be useful in applying a correction factor to more accurately localize features specific to the fluid migration profile. For example, if a geophysical map indicates an aquifer at 220 meters, and your system indicates it is at 250 meters of deployed cable, a correction factor of 30 meters may be applied to the static, dynamic and/or fluid migration profiles to allow for more accurate localization of the fluid migration profile feature.

Figure 10:
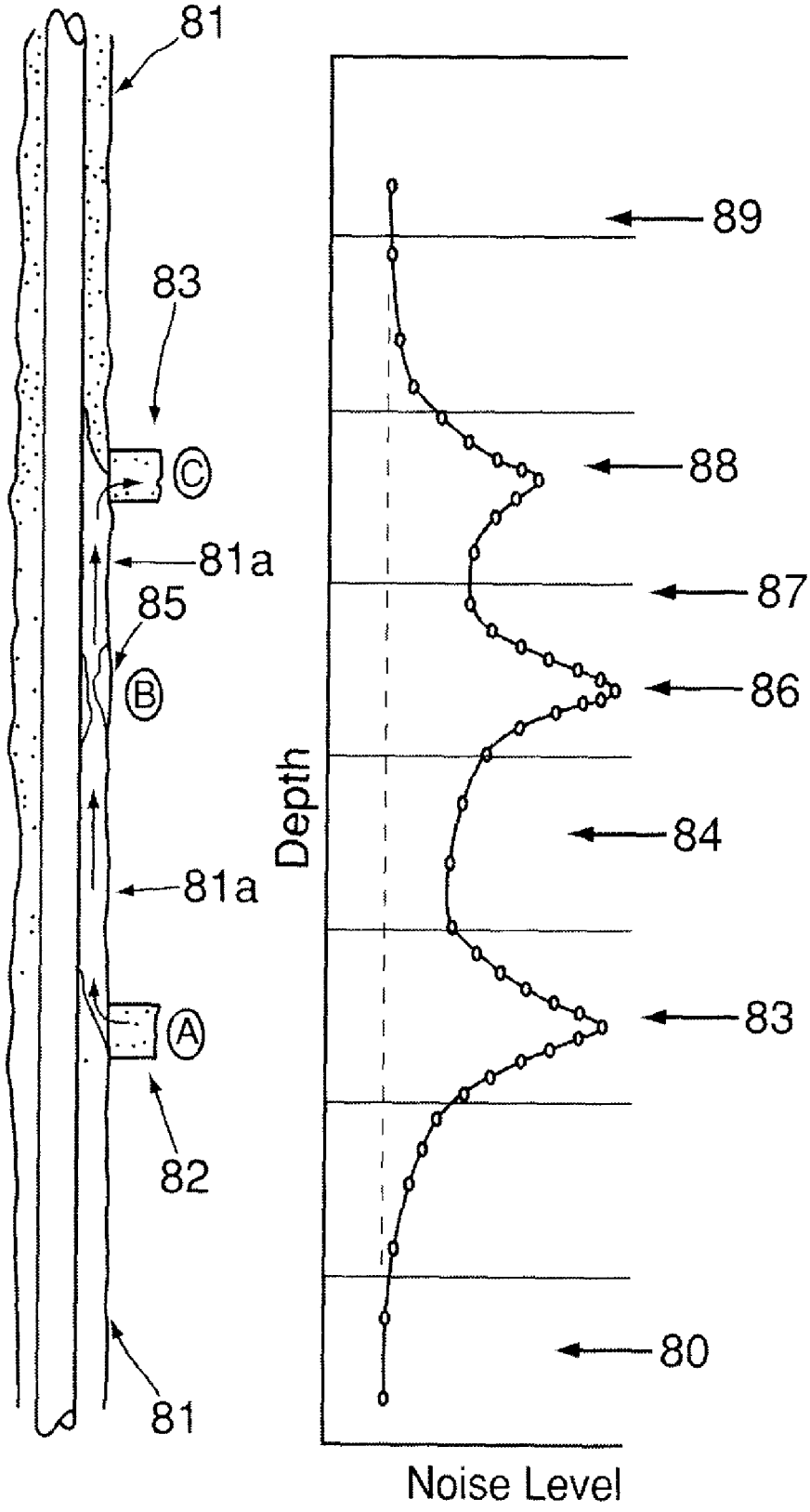
FIG. 10 shows an example of an acoustic well-logging trace (right panel) with the noise peaks aligned with wellbore aberrations that result in an aberrant noise profile as gas bubbles migrate upwards.
Figure 11A:
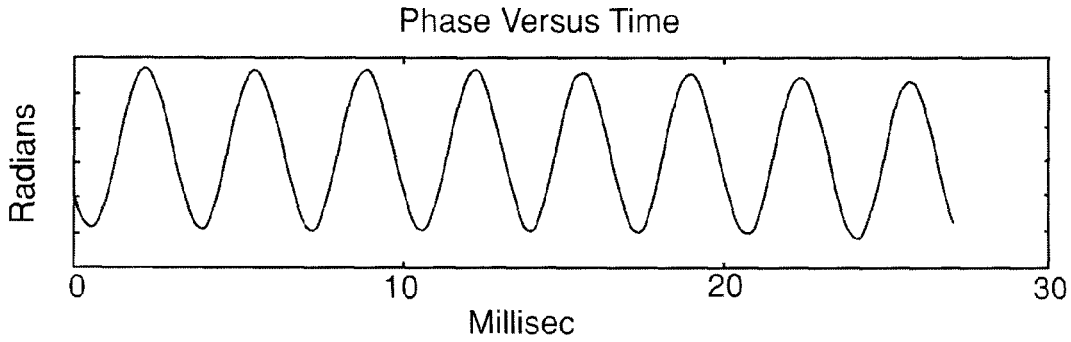
FIG. 11 shows (A) 300 Hz input sine wave and (B) a Fast Fourier Transform of the acoustic signal obtained using a packaged transducer comprising an 80 A durometer rubber core and 10 meter intervening length between fiber-Bragg gratings.
Figure 11B:
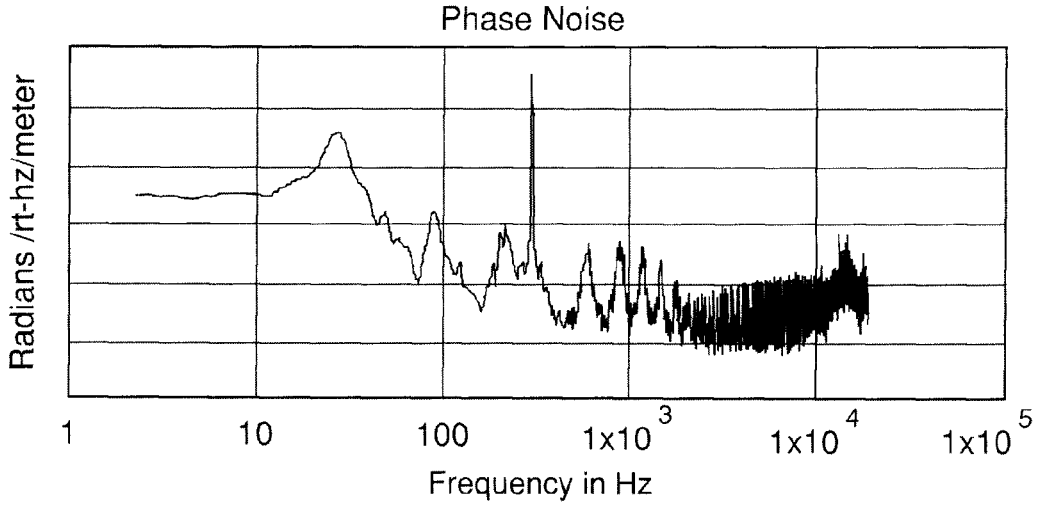
Figure 12A:
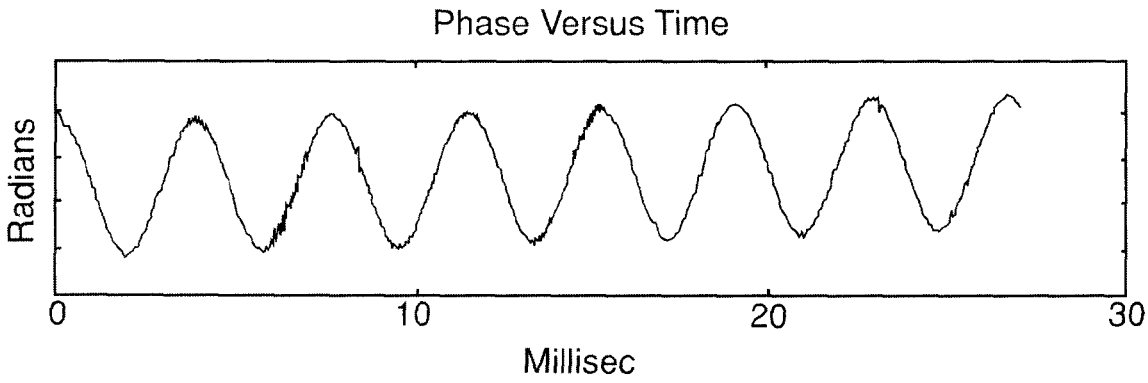
FIG. 12 shows (A) 300 Hz input sine wave and (B) a Fast Fourier Transform of the acoustic signal obtained using a straight two-transducer array having 10 meter intervening length between fiber-Bragg gratings.
Figure 12B:
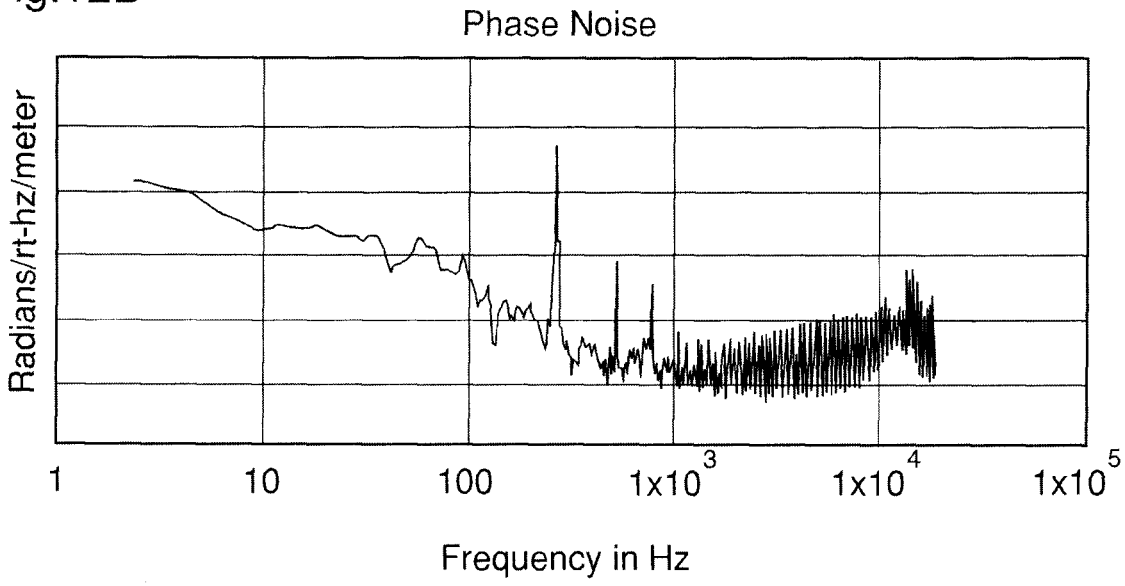

An example of processed and transformed data is shown in FIG. 10. In this example, acoustic data has been monitored and recorded over the entire depth of the wellbore. Acoustic signal level (noise) is plotted with respect to depth. A baseline level of acoustic activity (80) is initially determined. Detection of a first acoustic event peak (83) at the depth where a first fluid migration event occurs. The gas bubbles enter a cement casing (81) from the geological matrix (82) at (A), and rise up through pores or gaps (81*a*) in the cement casing (81). With little to no obstruction, noise is reduced (84), but does not return to background. A second acoustic event (86), having a different profile, is detected at (B), where there is a partial obstruction (85) of the fluid migration in the cement casing (81). This is recorded as another peak (86) on the acoustic profile. The bubble(s) continue the upward travel through gaps or pores (81*a*) in the cement casing (81) and again noise is reduced (87) but does not reach background. The bubbles are diverted back into the geological matrix (82) at (C) by an obstruction in the cement casing. This obstruction and diversion results in a third acoustic event (88) (peak) on the acoustic profile. Above this depth, the cement casing (81) is intact, and no fluid migration events are detected, and the noise level returns to background.

Such fluid migration events may also occur in the casing of an oil or gas well, surrounding the production tubing, or in the area between the casing and production tubing.

Alternate Embodiments

In some embodiments of the present invention, the cable having the array of transducers may be installed in the wellbore transiently. For example, an operating well with a suspected leak may be suspended and capped with cement, and the array of transducers lowered into the suspended well through an access port in the cement cap. The data is collected and analyzed, and the array removed.

In another embodiment of the invention, the array of transducers is installed in the wellbore permanently. The well may then be capped and abandoned following the usual procedures, and data transmission apparatus installed at to collect the data. Alternatively, the apparatus may be modified to convey the well logging data to a remote site by satellite or cellular phone. Examples of such data transmission apparatus are known in the art, for example, a Surface Readout Unit including a satellite antenna, solar array and power cable (Sabeus, Inc.).

In another embodiment of the invention, a downhole array of transducers may be used in a production survey of a well. A well may have multiple zones, each producing gas or oil at differing rates and/or with differing properties (temperature, pressure, composition and the like). Current methods of investigating zone production may involve use of a 'spinner tool'—a mechanical, turbine-like device with fan blades that rotate according to flow rate. Such devices are prone to clogging, and may have fluctuating accuracy due to frictional interactions of the components. Use of an array of transducers spanning at least one production zone may obviate such mechanical devices, by enabling passive acquisition of one or more downhole property profiles of the production zone. For example a noise, pressure, and/or temperature profile of a selected production zone may be correlated with gas or oil flow in the production tubing and/or casing from that zone.

In some other embodiments, a piezoelectric transducer may be used in conjunction with or instead of the acoustic transducer array 16. Selection of a transducer for use in an array may involve consideration of particular features related to robustness, flexibility of application, specificity of detection parameters, safety or environmental suitability, or the like. Additionally, transducers for detecting pressure, seismic vibration or temperature may be substituted for, or used in combination with at least one acoustic transducer.

As an example, in an environment where flammable or explosive gases or fluids may be present (such as a gas or oil well), a system employing fiber-Bragg gratings may provide a safety advantage over a system using electrical or electronic signal detection and/or transmission, in that the risk of sparking in an optical system is significantly reduced or may even be eliminated, thus reducing risk of explosion.

An array of transducers 16 may, once manufactured, be of a fixed 'resolution'—the distance between transducers cannot be adjusted. In order to log a region of a well with a resolution less than that of the array 16, the array may be repositioned in a staggered manner. For example, in an array having 10 transducers, each spaced 2 meters apart (the array has a 2 meter resolution, and is about 20 meters overall in length), the array is deployed to the maximum depth and the logged region monitored as described.

If a 1 meter resolution is desired, the same array may be employed. The first sampling period is performed as described, and the array raised 1 meter for the second sampling period. For the third sampling period, the array is raised 20 meters (one array span) and the sampling performed as described. For the fourth monitoring period, the array is again raised 1 meter and the sampling performed as described. This cycle of staggered raising and sampling is repeated until the desired region has been logged.

Use of a staggered raising and sampling cycle allows for a single array design to provide multiple monitoring resolutions.

EXAMPLES

The performance of an array of two fiber-Bragg grating transducers (straight array) was compared with that of a transducer having a polyurethane core or mandrel of 60 A or 80 A durometer using a test well configured to simulate gas leaks at varying depths and flow rates. For both the straight array and the transducers with mandrel, 10 m of fiber optic cable separated the gratings. The test well comprised an outer casing extending from above the ground level to below the ground level, with a sealed end below ground. An inner casing in parallel and centered with the outer casing extends from the below ground end of the outer casing to above the ground level or higher. The above ground end of the inner casing is threaded to enable attachment of a union or valve, as desired. Two line pipes were used as a flow line, and for filling and/or accessing an annulus formed between the inner and outer casings. A series of six steel tubes, extending to 3 depths of the well annulus were arranged to place one for each depth at each of two proximities (near and far) to the inner casing. The annulus was filled with packed sand to a level below the lower end of the mid-length steel tubes. The array or packed transducer to be tested was lowered into the inner casing, and a gas (air) was injected into the steel tubes to produce a fixed bubble rate. Acoustic signals were recorded in the absence of gas injection to obtain a baseline, a positive control input sine wave of 300 Hz and bubble rates ranging from 5 to 800 bubbles per minute.

The fiber optic cable comprising two fiber-Bragg gratings as a straight array or in combination with a mandrel as described above, was configured for testing purposes. When illuminated by an input pulse of light, a fiber Bragg grating reflects a narrow band of light at particular wavelength to which it is tuned. A length of fiber optic cable between a first and a second fiber-Bragg grating responds to a measurand such as strain induced by an acoustic event such as an input sine wave, bubbles, background noise, or the like, by a change in the separation distance between the gratings, which in turn induces a change in the wavelength of light being reflected and scattered. A Mach-Zehnder interferometer, in communication with the surface recording, processing and monitoring equipment (host computer, 2-channel oscilloscope and power source) was used to determine the phase shift of the optical signal. The phase shift is subsequently demodulated by a Fast Fourier Transform to identify the various frequency components from the background noise. Further details of the components and steps of the overall test configuration are as described above for the digital noise array as shown in FIG. 5; an illustration of an external modulator assembly is generally as shown in FIG. 6.

All data was taken with the sensors in the well. The interrogation approach involves a CS laser (Orbits Lightwave, Pasadena Calif.) into an external fiber stretcher (for modulation at 37 kHz), and in communication with an interferometer (sensor) having a nominal 20 meter fiber path mismatch. The refracted light was received by the demodulator (OPD4000) to measure optical phase variation.

OPD4000 conditions:

A) Demodulation card OPD-440P (with PDR receiver) (Optiphase, Inc.)

B) Demodulation rate: 37 kHz

C) Data record was 65536 points in length (1.7 seconds in duration)

D) Data was DC coupled

Data was processed and plotted: Time domain plot illustrated for the first 30 msec (actual scale shown in FIGS. 11-14). A FFT of four consecutive 16384 point sets was obtained, then averaged. The FFT is normalized to 1 Hz noise bandwidth. And normalized to a 1 m fiber path mismatch.

For all sensors, Bragg gratings were made at ITU35 standard (1549.32 nm) nominally with 1% reflection (Uniform type grating) (LxSix Photonics, St-Laurent, Quebec). The high durometer sensor (Optiphase) comprised 10 meters (grating separation 10 m) of single mode fiber (with 900 um acrylate) wound on polyurethane mandrel of high durometer (80 A). The medium durometer sensor (Optiphase) comprised 10 meters (grating separation 10 m) of single mode fiber (with 900 um acrylate) wound on polyurethane mandrel of high durometer (60 A). Both mandrels were 12 inches in length, 1.5 inches in diameter.

A 300 Hz sine wave input for the straight array (FIG. 12) and the 80 A durometer core transducer (FIG. 11) gave an identifiable signal. A single signal peak was identifiable in both.

Figure 13A:
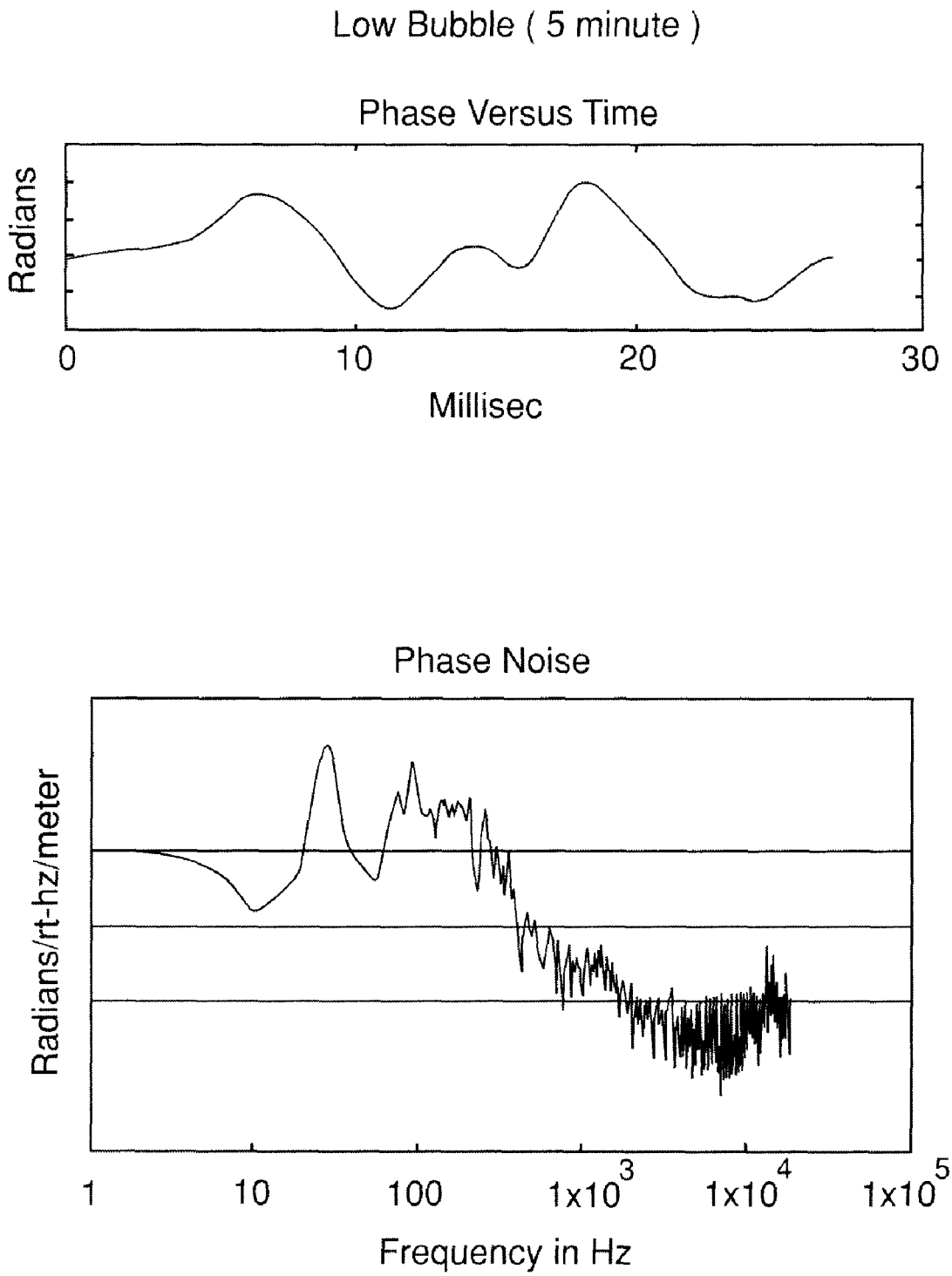
FIGS. 13A and 13B shows the input acoustic signal (top) and (bottom) Fast Fourier Transform of the input acoustic signal obtained using a packaged transducer comprising an 80 A durometer rubber core and 10 meter intervening length between fiber-Bragg gratings. (A) low bubble rate (5 bubbles per minute) and (B) baseline (background ambient noise).
Figure 13B:
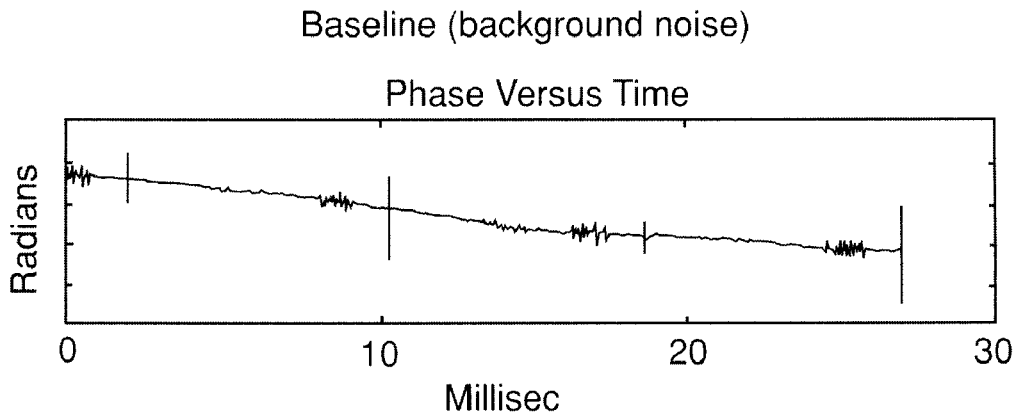
Figure 13B:
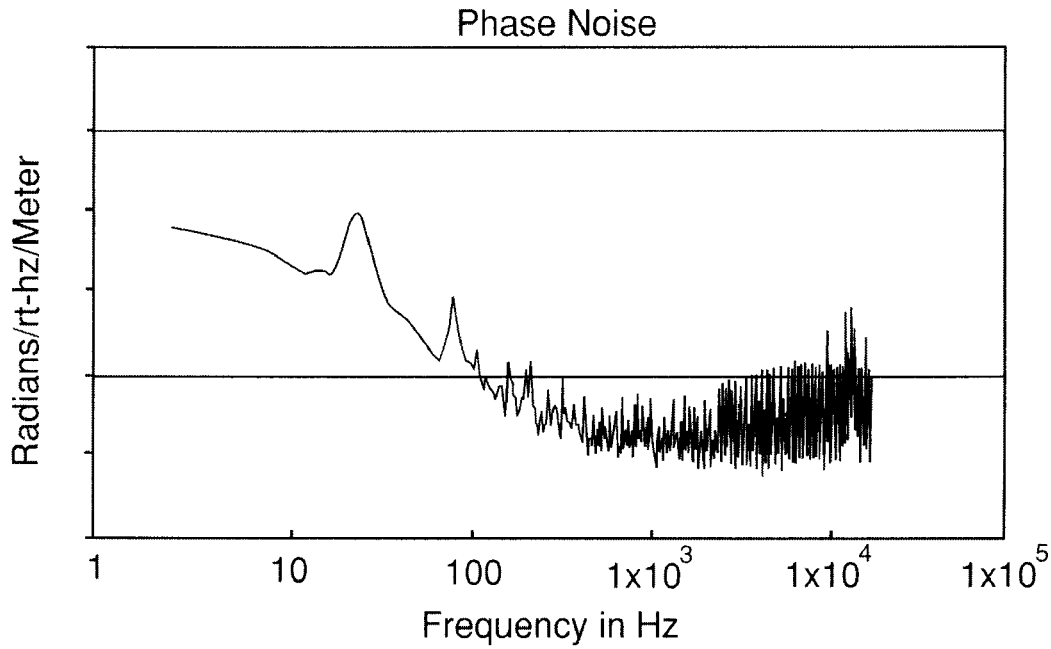

FIG. 13 shows the results of a test using a transducer having an 80 A durometer core to detect acoustic signals in the annulus of the test well at a low bubble rate (5 bubbles per minute (FIG. 13A) and at baseline (FIG. 13B).

Figure 14A:
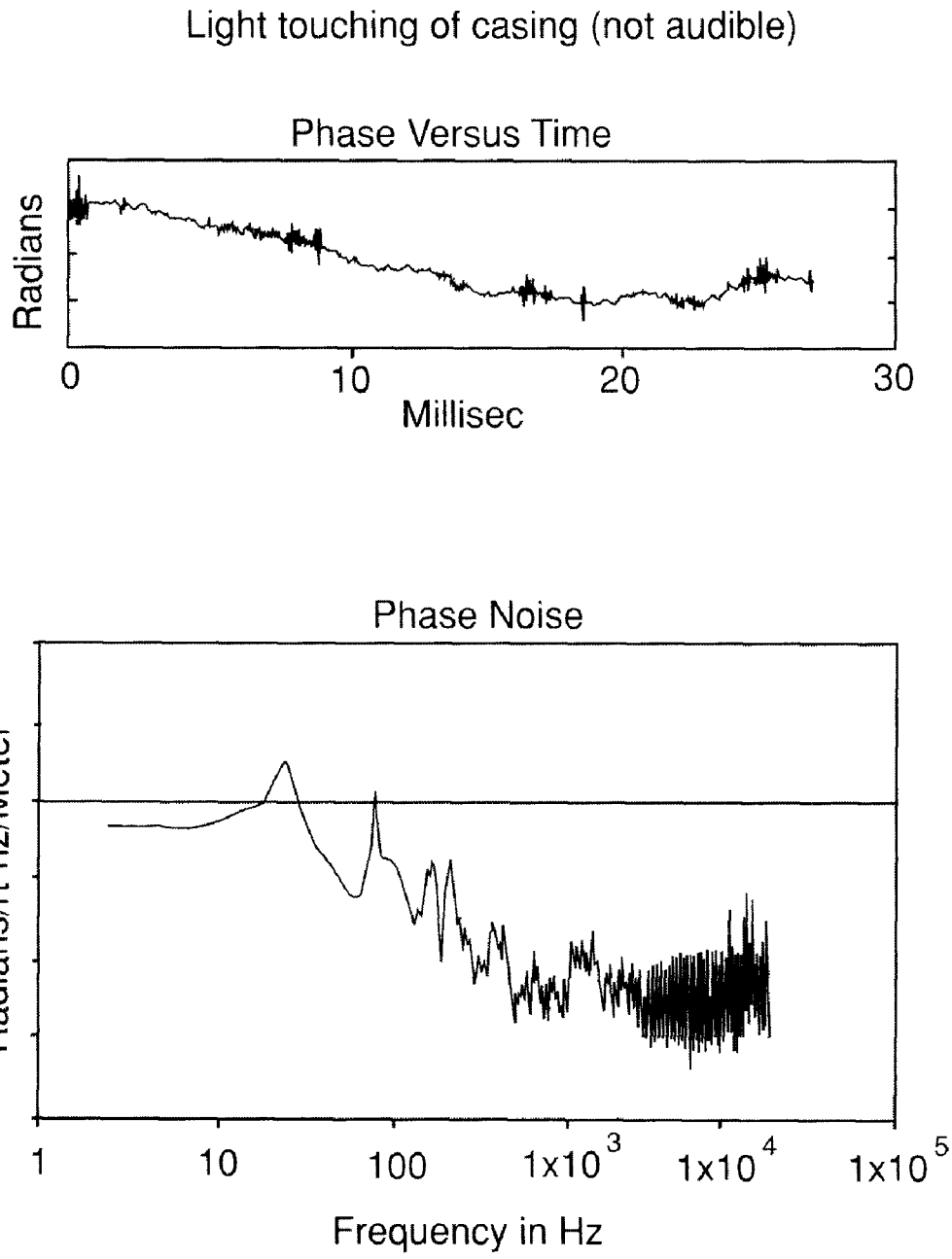
FIGS. 14A and 14B shows the input acoustic signal (top), and (bottom) Fast Fourier Transform of the input acoustic signal obtained using a packaged transducer comprising an 80 A durometer rubber core and 10 meter intervening length between fiber-Bragg gratings. (A) light manual rubbing of exterior casing and (B) baseline (background ambient noise).
Figure 14B:
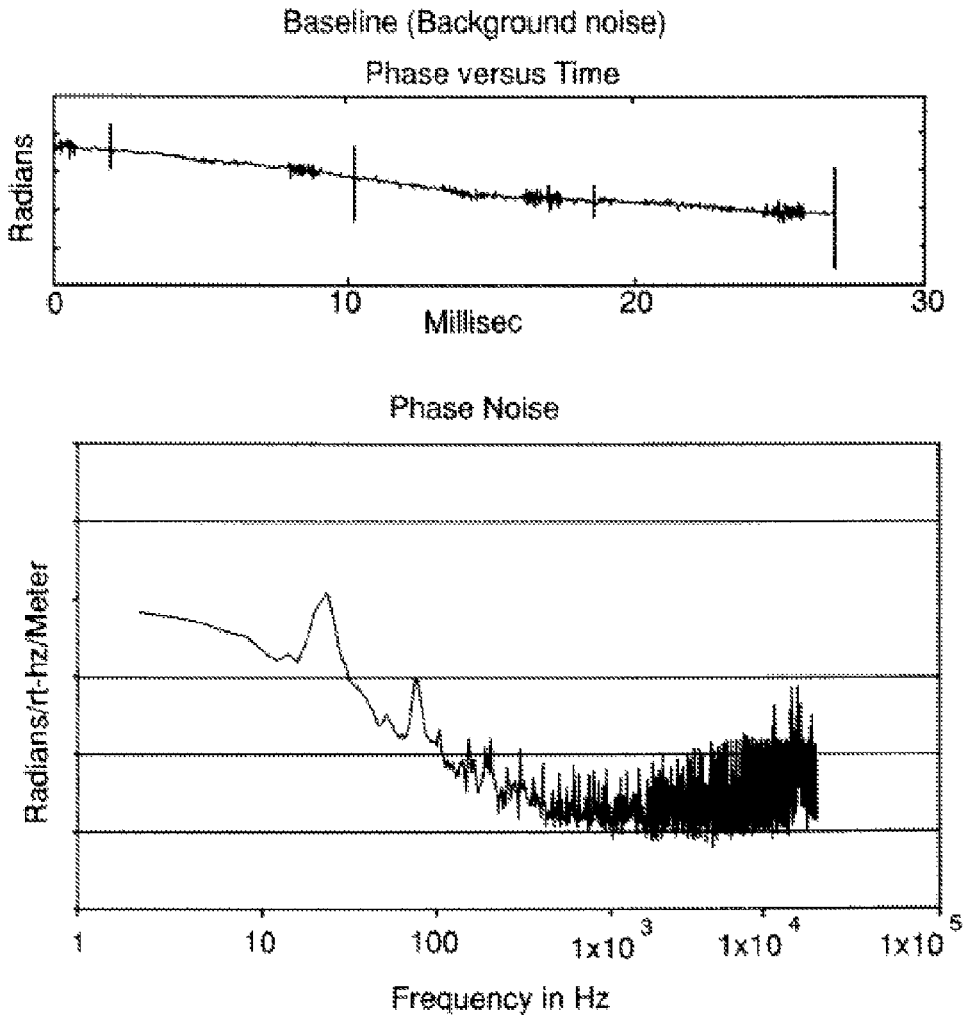

FIG. 14 shows the results of a test using a packaged transducer having an 80 A durometer core to detect acoustic signals in the annulus of the test well at baseline (FIG. 14B), and when the casing is lightly rubbed by hand (FIG. 14A). Acoustic signals generated by manual rubbing produced a profile similar in overall amplitude but with lower frequency signals and a different peak distribution relative to background, and also differing from that produced by gas bubbles in the annulus. A loss of linearity compared to the baseline is also observed.

These data demonstrate that acoustic signals produced by migrating gas bubbles are detectable and differentiable over acoustic signals produced by contact events (friction) at the ground level and that of the ambient baseline noise.

All citations disclosed are herein incorporated by reference.

The present invention has been described with regard to one or more embodiments. However, it will be apparent to persons skilled in the art that a number of variations and modifications can be made without departing from the scope of the invention as defined in the claims.

What is claimed is:

1. A method of obtaining a static noise profile for a region of a wellbore comprising:

a) placing a fiber optic cable in the wellbore to a depth of at least a portion of the wellbore;

b) pressurizing the wellbore and allowing the pressure to equilibrate;

c) operating a laser light assembly to send laser light along the fiber optic cable, the fiber optic cable including a single mode or a multi-mode fiber optic line;

d) collecting data from the fiber optic line using coherent Rayleigh or digital noise array techniques;

e) demodulating the collected coherent Rayleigh data or digital noise array data; and f) transforming the demodulated coherent Rayleigh data or digital noise array data to obtain the static noise profile of the wellbore at the given depth.

2. The method of claim 1, further comprising:

g) incrementally raising or lowering the fiber optic cable a defined distance within the wellbore;

h) operating the laser light assembly to send laser light along the fiber optic cable;

i) collecting data from the fiber optic line using the coherent Rayleigh or digital noise array techniques;

j) demodulating the collected coherent Rayleigh data or digital noise array data; and k) repeating steps (g) to (j), if necessary, until the static noise profile of an entire desired length of the wellbore is obtained.

3. The method of claim 1, wherein the fiber optic cable is configured for collecting coherent Rayleigh data, and the fiber optic cable comprises a single mode optical fiber.

4. The method of claim 1, wherein the fiber optic cable is configured for collecting digital noise array data, and such fiber optic cable comprises a single mode optical fiber includes a plurality of optical filters separated by an intervening length of single mode optical fiber.

5. The method of claim 4, wherein the optical filters include fiber Bragg gratings.

6. The method of claim 1, further comprising:

storing a transformation protocol on an electronic storage means; and using the transformation protocol to demodulate the coherent Rayleigh data or digital noise array data to form demodulated data.

7. The method of claim 6, further comprising:

storing an integration protocol on the electronic storage means; and using the integration protocol to integrate the demodulated data over time.

8. A method of determining the location of a source of fluid migration along the length of a wellbore comprising:

a) positioning a fiber optic cable including an array of fiber optic transducers in the wellbore in a first location therein to form a first array span along a length of the wellbore;

b) pressurizing the wellbore;

c) causing a laser light emitting source to send light down the fiber optic cable to the fiber optic transducers;

d) collecting data from the fiber optic transducers using coherent Rayleigh techniques; or
digital noise array data collection techniques;

e) raising, or lowering, by one array span, the fiber optic transducers within the wellbore;

f) repeating steps c-e until a desired length of the wellbore has been logged, the collected data forming a static noise profile for the wellbore;

g) releasing pressure in the wellbore;

h) operating the laser light assembly to send laser light along the fiber optic cable to the fiber optic transducers; the fiber optic cable comprising a single mode or a multi-mode fiber optic line;

i) collecting further data from the fiber optic transducers using coherent Rayleigh or digital noise array techniques;

j) incrementally raising or lowering the fiber optic cable a defined distance within the wellbore;

k) repeating steps (h) to (j) to collect further data until a dynamic noise profile of the desired length of the wellbore is obtained;

l) using a digital filtering protocol for digitally filtering the dynamic noise profile obtained in step (k) above to remove elements represented by the static noise profile obtained in step (f) above.

9. The method of claim 8, further comprising:

a) demodulating data collected;

b) integrating the demodulated data over time so as to amplify small occurrences; and c) from the integrated data determining a location of any gas migration along the length of the wellbore by analyzing frequency components to determine events which may indicate escape of bubbles and thus a source of gas migration at a given array position within the wellbore.

10. An apparatus for obtaining a fluid migration profile for a wellbore comprising:

a) a fiber optic cable assembly operable to obtain a static profile and a dynamic profile for a logged region of the wellbore, the static profile comprising events unrelated to fluid migration in the wellbore and the dynamic profile comprising events related and unrelated to fluid migration in the wellbore; and b) a data acquisition unit comprising:

a laser light assembly optically coupled to and operable to transmit laser light to the fiber optic cable assembly;

optical signal processing equipment optically coupled to and operable to process optical signals from the fiber optic cable assembly representing the static and dynamic profiles; and a computer-readable device storing computer instructions for causing the optical signal processing equipment to perform processing the static and dynamic profiles to filter out events unrelated to fluid migration from the static profile, thereby obtaining a fluid migration profile.

11. The apparatus of claim 10, wherein the fiber optic cable assembly is configured for at least one of collecting coherent Rayleigh data or collecting digital noise array data.

12. The apparatus of claim 11, wherein the fiber optic cable assembly configured for collecting coherent Rayleigh data comprises a single mode optical fiber.

13. The apparatus of claim 11, wherein the fiber optic cable assembly configured for collecting digital noise array data comprises a single mode optical fiber comprising a plurality of optical filters separated by an intervening length of single mode optical fiber.

14. The apparatus of claim 13, wherein the intervening length of single mode optical fiber is would around a mandrel.

15. The apparatus of claim 13, wherein the optical filters comprise fiber Bragg gratings.

16. A method for obtaining a fluid migration profile for a wellbore, comprising the steps of:

a) obtaining a static profile for a logged region of the wellbore, the static profile including events unrelated to fluid migration in the wellbore;

b) obtaining a dynamic profile for the logged region of the wellbore, the dynamic profile including events related and unrelated to fluid migration in the wellbore, wherein obtaining the dynamic profile for the logged region of the wellbore comprises the steps of:

i) positioning a fiber optic cable assembly in the wellbore at a first location, wherein the wellbore is pressurized;

ii) releasing the pressure in the wellbore;

iii) operating a laser light assembly to send laser light along a coherent Rayleigh transmission line or digital noise array transmission line;

iv) collecting coherent Rayleigh data or digital noise array data;

v) demodulating the collected coherent Rayleigh data or digital noise array data; and vi) transforming the demodulated coherent Rayleigh data, or digital noise array data; and c) digitally processing the static and dynamic profiles to filter out the events unrelated to fluid migration from the static profile, thereby obtaining the fluid migration profile.

17. The method of claim 16, wherein the static profile is obtained by a measurement method which acquires event data comprising at least one of coherent Rayleigh data or digital noise array data.

18. The method of claim 16, wherein obtaining a static profile for a logged region of the wellbore comprises the steps of:

a) placing the fiber optic cable assembly in the wellbore at the first location;

b) pressurizing the wellbore and allowing the pressure to equilibrate;

c) operating the laser light assembly to send laser light along the coherent Rayleigh transmission line or digital noise array transmission line;

d) collecting coherent Rayleigh data or digital noise array data;

e) demodulating the collected coherent Rayleigh data or digital noise array data; and f) transforming the demodulated coherent Rayleigh data or digital noise array data.

19. The method of claim 18, wherein the step for collecting digital noise array data further comprises raising the digital noise array by one array span in step d) and repeating steps d) to f).

20. The method of claim 16, wherein the step for collecting digital noise array data further comprises raising the digital noise array by one array span in step iv) and repeating steps iv) to vi).

21. A computer-readable device storing computer instructions for execution by a computer to carry out the method of claim 16.

* * * * *